US009726328B2

(12) United States Patent
Yoshida

(10) Patent No.: US 9,726,328 B2
(45) Date of Patent: Aug. 8, 2017

(54) FLOW-PATH FORMING MEMBER, LIQUID EJECTING HEAD, AND LIQUID EJECTING APPARATUS

(71) Applicant: Seiko Epson Corporation, Tokyo (JP)

(72) Inventor: Ayumi Yoshida, Matsumoto (JP)

(73) Assignee: Seiko Epson Corporation (JP)

( * ) Notice: Subject to any disclaimer, the term of this patent is extended or adjusted under 35 U.S.C. 154(b) by 135 days.

(21) Appl. No.: 14/644,639

(22) Filed: Mar. 11, 2015

(65) Prior Publication Data

US 2015/0267868 A1 Sep. 24, 2015

(30) Foreign Application Priority Data

Mar. 19, 2014 (JP) ..... 2014-056180

(51) Int. Cl.
*B41J 2/18* (2006.01)
*F17D 1/08* (2006.01)

(52) U.S. Cl.
CPC ..... *F17D 1/08* (2013.01); *Y10T 137/9029* (2015.04)

(58) Field of Classification Search
CPC B41J 2/17596; B41J 2/17593; B41J 2/17566; B41J 2/17563; B41J 2/17503; B41J 2/175; B41J 2/18; B41J 2/055; B41J 2/14419; B41J 2/14233; B41J 2/155
See application file for complete search history.

(56) References Cited

U.S. PATENT DOCUMENTS 7,537,319 B2 * 5/2009 Jung ..... B41J 2/055 347/68

FOREIGN PATENT DOCUMENTS

JP 2012-210771 A 11/2012

* cited by examiner

*Primary Examiner* — Kristal Feggins
(74) *Attorney, Agent, or Firm* — Harness, Dickey & Pierce P.L.C.

(57) ABSTRACT

A first flow path through which liquid flows in an intersection direction intersecting a vertical direction and a second flow path which is connected to the first flow path and through which liquid flows downward in the vertical direction are provided. The first flow path includes an intersection portion which has a surface intersecting the intersection direction and which allows a cross-sectional area of the first flow path to be gradually reduced in a plane perpendicular to the intersection direction as the first flow path extends to the second flow path.

19 Claims, 21 Drawing Sheets

FLOW-PATH FORMING MEMBER, LIQUID EJECTING HEAD, AND LIQUID EJECTING APPARATUS

CROSS REFERENCES TO RELATED APPLICATIONS

This application claims priority to Japanese Patent Application No. 2014-056180 filed on Mar. 19, 2014. The entire disclosure of Japanese Patent Application No. 2014-056180 is hereby incorporated herein by reference.

BACKGROUND

1. Technical Field

The present invention relates to a flow-path forming member in which liquid is ejected from nozzle openings, a liquid ejecting head, and a liquid ejecting apparatus.

2. Related Art

An ink jet type recording head which includes a head main body in which a pressure generation chamber communicating with a nozzle opening through which ink droplets are discharged is deformed by a pressure generation unit, such as a piezoelectric element, in such a manner that ink droplet is discharged through the nozzle opening and a flow-path member which constitutes a flow path of ink supplied to the head main body is known as a liquid ejecting head.

In such an ink jet type recording head, it is necessary to reduce pressure loss in a flow path when a plurality of heads has a common ink supply source or the distance from the ink supply source to the head is long.

Furthermore, although air bubbles are likely to remain on an upper side of a flow path in a vertical direction, it is necessary to allow the air bubbles to flow downstream while preventing the air bubbles from remaining in the flow path. It is preferable that flow velocity is great, in terms of allowing the air bubbles to flow downstream. However, when the flow velocity is great, the pressure loss increases, and thus it is unpreferable.

Here, technique in which, in a connection portion between a flat flow path and a vertical flow path, a flow path on an upper side in a vertical direction have a cycloid curve shape, in such a manner that air bubbles are prevented from remaining on the upper side of the connection portion in the vertical direction has been disclosed (see JPA-2012-210771).

However, only a problem in relation to discharge of air bubbles is considered and a problem in relation to pressure loss is not considered in JP-A-2012-210771 described above. Accordingly, it is necessary to provide a flow path structure in which both improvement in air-bubble discharge properties and a reduction in pressure loss can be achieved.

Such a problem is not limited to an ink jet type recording head but is shared by a liquid ejecting head unit which ejects liquid other than ink.

SUMMARY

An advantage of some aspects of the invention is to provide a flow-path forming member in which both improvement in air-bubble discharge properties and a reduction in pressure can be achieved, a liquid ejecting head, and a liquid ejecting apparatus.

Aspect 1

According to an aspect of the invention, there is provided a flow-path forming member which includes a first flow path through which liquid flows in an intersection direction intersecting a vertical direction and a second flow path which is connected to the first flow path and through which liquid flows downward in the vertical direction. The first flow path includes an intersection portion which has a surface intersecting the intersection direction and which allows a cross-sectional area of the first flow path to be gradually reduced in a plane perpendicular to the intersection direction as the first flow path extends to the second flow path.

In this aspect, the first flow path includes the intersection portion, and thus the cross-sectional area of the flow path of the intersection portion is gradually reduced. As a result, it is possible to reduce the pressure loss in a part of the first flow path, which is the portion to the intersection portion. In addition, the flow velocity in the intersection portion increases, and thus air bubbles are prevented from remaining on the upper side of the connection portion between the first flow path and the second flow path.

Aspect 2

In the flow-path forming member according to Aspect 1, it is preferable that the intersection portion of the first flow path has the intersection surface on a lower side in the vertical direction. In this aspect, the flow of liquid is directed to the upper side of the intersection portion in the vertical direction. As a result, it is possible to more reliably prevent air bubbles from remaining on the upper side of the connection portion in the vertical direction.

Aspect 3

In the flow-path forming member according to Aspects 1 and 2, it is preferable that a plurality of groups of the first flow paths and the second flow paths are provided. In addition, it is preferable that the respective first flow paths of the plurality of groups communicate with a distribution flow path. Furthermore, it is preferable that the distribution flow path communicates with an inlet port to which a liquid from a liquid supply source is supplied from the vertical direction. It is preferable that the respective intersection portions of the first flow paths of the groups have different shapes in accordance with distances from the inlet port to the respective second flow paths. In this aspect, the intersection portion is designed in consideration of the amount of the pressure loss in each flow path which extends from the inlet port to the intersection portion. As a result, the pressure loss in the intersection portion is adjusted, and thus variation in pressure losses in the groups can be reduced.

Aspect 4

In the flow-path forming member according to Aspect 3, it is preferable that the groups of the first flow paths and the second flow paths include a first group and a second group in which the distance from the inlet port to the second flow path is longer than that of the first group. In addition, it is preferable that the distance from a start position of the intersection portion of the first group to the second flow path thereof is longer than that of the second group. In this aspect, the distances from the second flow paths to the start points of the intersection portions are adjusted, in such a manner that variation in the pressure losses in the groups can be reduced, in which the pressure loss increases as the distance from the inlet port increases.

Aspect 5

In the flow-path forming member according to Aspects 3 and 4, it is preferable that the groups of the first flow paths and the second flow paths include a first group and a second group in which the distance from the inlet port to the second flow path is longer than that of the first group. Furthermore, it is preferable that the distance from an end position of the intersection portion of the first group to the second flow path is longer than that of the second group. In this aspect, the distances from the second flow paths to the end points of the intersection portions are adjusted, in such a manner that variation in the pressure losses in the groups can be reduced, in which the pressure loss increases as the distance from the inlet port increases.

Aspect 6

In the flow-path forming member according to Aspects 3 to 5, it is preferable that the cross-sectional area of a part of the distribution flow path, which is the portion from the inlet port to a first bifurcation flow path which branches off first is greater than the cross-sectional area of a part of the distribution flow path, which is the portion downstream from the first bifurcation flow path which branches off first. In this aspect, even when the flow rate in the distribution flow path changes in accordance with the number of the first flow paths connected to the distribution flow path, the cross-sectional area of the distribution flow path changes in accordance with the number of bifurcation portions, in such a manner that variation in the flow velocity in the distribution flow path can be reduced.

Aspect 7

In the flow-path forming member according to Aspects 1 to 6, it is preferable that the flow-path forming member further includes a first member and a second member. In addition, it is preferable that the first flow path is formed by the first member and the second member. Furthermore, it is preferable that the intersection portion is formed not in the first member but in the second member. In this aspect, it is easy to perform processing, compared to in the case where the intersection portion is formed over the first member and the second member.

Aspect 8

In the flow-path forming member according to Aspect 7, it is preferable that a part of the intersection portion, which decides the cross-sectional area, is located further on the second member side than an overlapping surface between the first member and the second member. When a part of the intersection portion, which decides the second cross-sectional area, is located in the overlapping surface between the first member and the second member or on the first member side, it is difficult to manage an adhesion surface. However, in this aspect, the intersection portion is provided on the second member side, and thus it is relatively easy to manage the adhesion surface.

Aspect 9

In the flow-path forming member according to Aspects 7 and 8, it is preferable that the flow-path forming member further includes a third member. In addition, it is preferable that, when a plurality of groups of the first flow paths and the second flow paths are provided, there is a first flow path formed by the second member and the third member, in addition to a first flow path formed by the first member and the second member. In this aspect, the first flow paths are formed in both sides of the second member. As a result, it is possible to reduce the number of parts.

Aspect 10

In the flow-path forming member according to Aspect 9, it is preferable that the intersection portion of the first flow path formed by the second member and the third member is formed not in the second member but in the third member. In this aspect, it is easy to perform processing, compared to in the case where the intersection portion is formed by the second member and the third member.

Aspect 11

In the flow-path forming member according to Aspects 9 and 10, it is preferable that, when a first flow path of a first stage, which is formed by the first member and the second member, and a first flow path of a second stage, which is formed by the second member and the third member, are projected onto a plane including the intersection direction and the vertical direction, the projection images thereof do not overlap each other. In this aspect, the first flow path of the first stage and the first flow path of the second stage can be arranged close to each other in a direction intersecting the vertical direction. As a result, it is possible to reduce the size of the flow-path forming member in the direction intersecting the vertical direction.

Aspect 12

In the flow-path forming member according to Aspects 9 and 10, it is preferable that, when a first flow path of a first stage, which is formed by the first member and the second member, and a first flow path of a second stage, which is formed by the second member and the third member, are projected onto a plane including the intersection direction and the vertical direction, the projection images thereof overlap each other. In this aspect, the first flow path of the first stage and the first flow path of the second stage overlap in the vertical direction. As a result, it is possible to reduce the size of the flow-path forming member in the direction intersecting the vertical direction.

Aspect 13

In the flow-path forming member according to Aspects 9 to 12, it is preferable that a plurality of groups of the first flow paths and the second flow paths of the first stage and a plurality of groups of the first flow paths and the second flow paths of the second stage are provided. In addition, it is preferable that the respective first flow paths of the first stage communicate with a first distribution flow path and the respective first flow paths of the second stage communicate with a second distribution flow path. Furthermore, it is preferable that the respective first distribution flow paths and the respective second distribution flow paths communicate with inlet ports to which liquid from a liquid supply source is supplied from the vertical direction. It is preferable that the cross-sectional area of the first distribution flow path is smaller than that of the second distribution flow path. In this aspect, variation in the pressure loss in the flow path extending to the first flow path of the first stage and variation in the pressure loss in the flow path extending to the first flow path of the second stage can be adjusted by the cross-sectional areas of the distribution flow paths of the respective stages.

Aspect 14

In the flow-path forming member according to Aspects 1 to 13, it is preferable that the cross-sectional area of the second flow path is smaller than that of the first flow path communicating with the second flow path. In this aspect, the flow velocity in the second flow path increases, in such a manner that it is possible to cause air bubbles to effectively flow.

Aspect 15

According to another aspect of the invention, there is provided a liquid ejecting head which includes the flow-path forming member according to any one of Aspects 1 to 14 and a head main body which receives liquid from the flow-path forming member and ejects the liquid.

In this aspect, the first flow path includes the intersection portion, and thus the cross-sectional area of the flow path of the intersection portion is gradually reduced. As a result, it is possible to reduce the pressure loss in a part of the first flow path, which is the portion to the intersection portion. In addition, the flow-path member in which the flow velocity in the intersection portion increases, and thus air bubbles can be prevented from remaining on the upper side of the connection portion between the first flow path and the second flow path is provided. As a result, it is possible to provide a liquid ejecting head having a flow-path member in which pressure loss is reduced and excellent air-bubble discharge properties are ensured.

Aspect 16

According to still another aspect of the invention, there is provided a liquid ejecting apparatus which includes the liquid ejecting head according to Aspect 15.

In this aspect, the first flow path includes the intersection portion, and thus the cross-sectional area of the flow path of the intersection portion is gradually reduced. As a result, it is possible to reduce the pressure loss in a part of the first flow path, which is the portion to the intersection portion. In addition, the flow-path member in which the flow velocity in the intersection portion increases, and thus air bubbles can be prevented from remaining on the upper side of the connection portion between the first flow path and the second flow path is provided. As a result, it is possible to provide a liquid ejecting apparatus having a flow-path member in which pressure loss is reduced and excellent air-bubble discharge properties are ensured.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
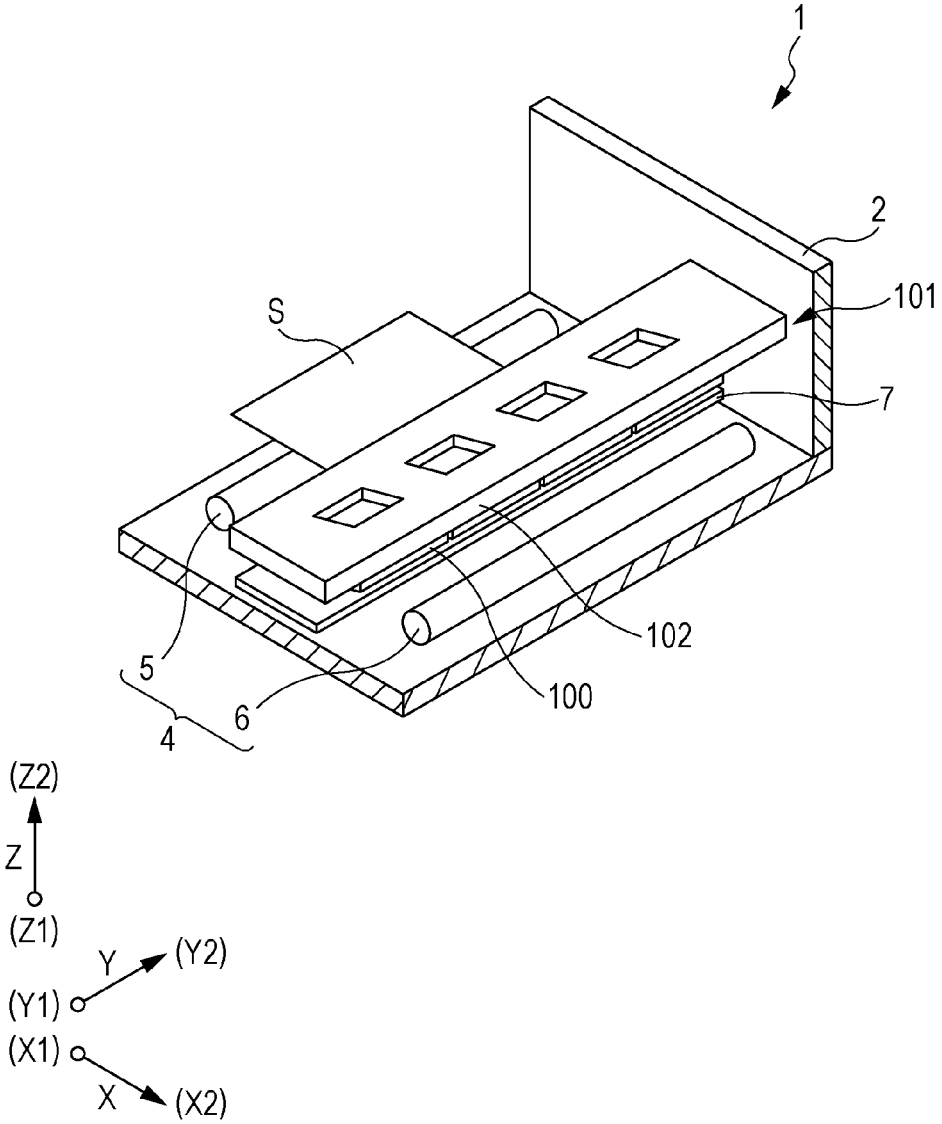
FIG. 1 is a schematic perspective view of a recording apparatus according to Embodiment 1 of the invention.

Details of embodiments of the invention will be described. An ink jet type recording head is an example of a liquid ejecting head and also referred to simply as a recording head. An ink jet type recording unit is an example of a liquid ejecting head unit and also referred to simply as a head unit. An ink jet type recording apparatus is an example of a liquid ejecting apparatus. FIG. 1 is a perspective view illustrating the schematic configuration of an ink jet type recording apparatus according to this embodiment.

An ink jet type recording apparatus 1 is a so-called line type recording apparatus, as illustrated in FIG. 1. The ink jet type recording apparatus 1 includes a head unit 101. In the ink jet type recording apparatus 1, a recording sheet S, such as a paper sheet as an ejection target medium, is transported, in such a manner that printing is performed.

Specifically, the ink jet type recording apparatus includes an apparatus main body 2, the head unit 101, a transport unit 4, and a support member 7. The head unit 101 has a plurality of recording heads 100. The transport unit 4 transports the recording sheet S. The support member 7 supports the recording sheet S facing the head unit 101. In this embodiment, a transporting direction of the recording sheet S is set to an X direction. In a liquid ejection surface of the head unit 101, in which nozzle openings are provided, a direction perpendicular to the X direction is set to a Y direction. A direction perpendicular to both the X direction and the Y direction is set to a Z direction. In this embodiment, the Z direction is parallel to a vertical direction. In the X direction, an upstream direction in which the recording sheet S is transported is set to an X1 direction and a downstream direction is set to an X2 direction. In the Y direction, one direction is set to a Y1 direction and the other is set to a Y2 direction. In the Z direction, a direction (toward the recording sheet S) parallel to a liquid ejecting direction is set to a Z1 direction and an opposite direction is set to a Z2 direction.

The head unit 101 includes a plurality of recording heads 100 and a head fixing substrate 102 which holds a plurality of recording heads 100.

The plurality of recording heads 100 is fixed to the head fixing substrate 102, in a state where the recording heads 100 are aligned in the Y direction intersecting the X direction which is the transporting direction. In this embodiment, the plurality of recording heads 100 are aligned in a straight line extending in the Y direction. In other words, the plurality of recording heads 100 are arranged so as not to be shifted toward the X direction. Accordingly, the X-direction width of head unit 101 is reduced, and thus it is possible to reduce the size of the head unit 101.

The head fixing substrate 102 holds the plurality of recording heads 100, in a state where the nozzle openings of the plurality of recording heads 100 are directed toward the recording sheet S. The head fixing substrate 102 holds a plurality of the recording heads 100 and is fixed to the apparatus main body 2.

The transport unit 4 transports the recording sheet S in the X direction, with respect to the head unit 101. The transport unit 4 includes a first transport roller 5 and a second transport roller 6 which are provided, in relation with the head unit 101, for example, on both sides in the X direction as the transporting direction of the recording sheet S. The recording sheet S is transported, in the X direction, by the first transport roller 5 and the second transport roller 6. The transport unit 4 for transporting the recording sheet S is not limited to a transport roller. The transport unit 4 may be constituted of a belt, a drum, or the like.

The support member 7 supports the recording sheet S transported by the transport unit 4, at a position facing the head unit 101. The support member 7 is constituted of, for example, a metal member or a resin member of which the cross-sectional surface has a rectangular shape. The support member 7 is disposed in an area between the first transport roller 5 and the second transport roller 6, in a state where the support member 7 faces the head unit 101.

An adhesion unit which is provided in the support member 7 and causes the recording sheet S to adhere thereto may be provided in the support member 7. Examples of the adhesion unit include a unit which causes the recording sheet S to adhere thereto by sucking up the recording sheet S and a unit which causes the recording sheet S to be adhered thereto by electrostatically attracting the recording sheet S using electrostatic force. Furthermore, when the transport unit 4 is constituted of a belt or a drum, the support member 7 is located at a position facing the head unit 101 and causes the recording sheet S to be supported on the belt or the drum.

Although not illustrated, a liquid storage unit, such as an ink tank and an ink cartridge in which ink is stored, is connected to each recording head 100 of the head unit 101, in a state where the liquid storage unit can supply ink to the recording head 100. The liquid storage unit may be held on, for example, the head unit 101. Alternatively, in the apparatus main body 2, the liquid storage unit is held at a position separate from the head unit 101. A flow path and the like through which the ink supplied from the liquid storage unit is supplied to the recording head 100 may be provided in the inner portion of the head fixing substrate 102. Alternatively, an ink flow-path may be provided in the head fixing substrate 102 and ink from the liquid storage unit may be supplied to the recording head 100 through the ink flow-path member. Needless to say, ink may be directly supplied from the liquid storage unit to the recording head 100, without passing through the head fixing substrate 102 or the ink flow-path member fixed to the head fixing substrate 102.

In such an ink jet type recording apparatus 1, the recording sheet S is transported, in the X direction, by the first transport roller 5, and then the head unit 101 performs printing on the recording sheet S supported on the support member 7. The recording sheet S subjected to printing is transported, in the X direction, by the second transport roller 6.

Figure 2:
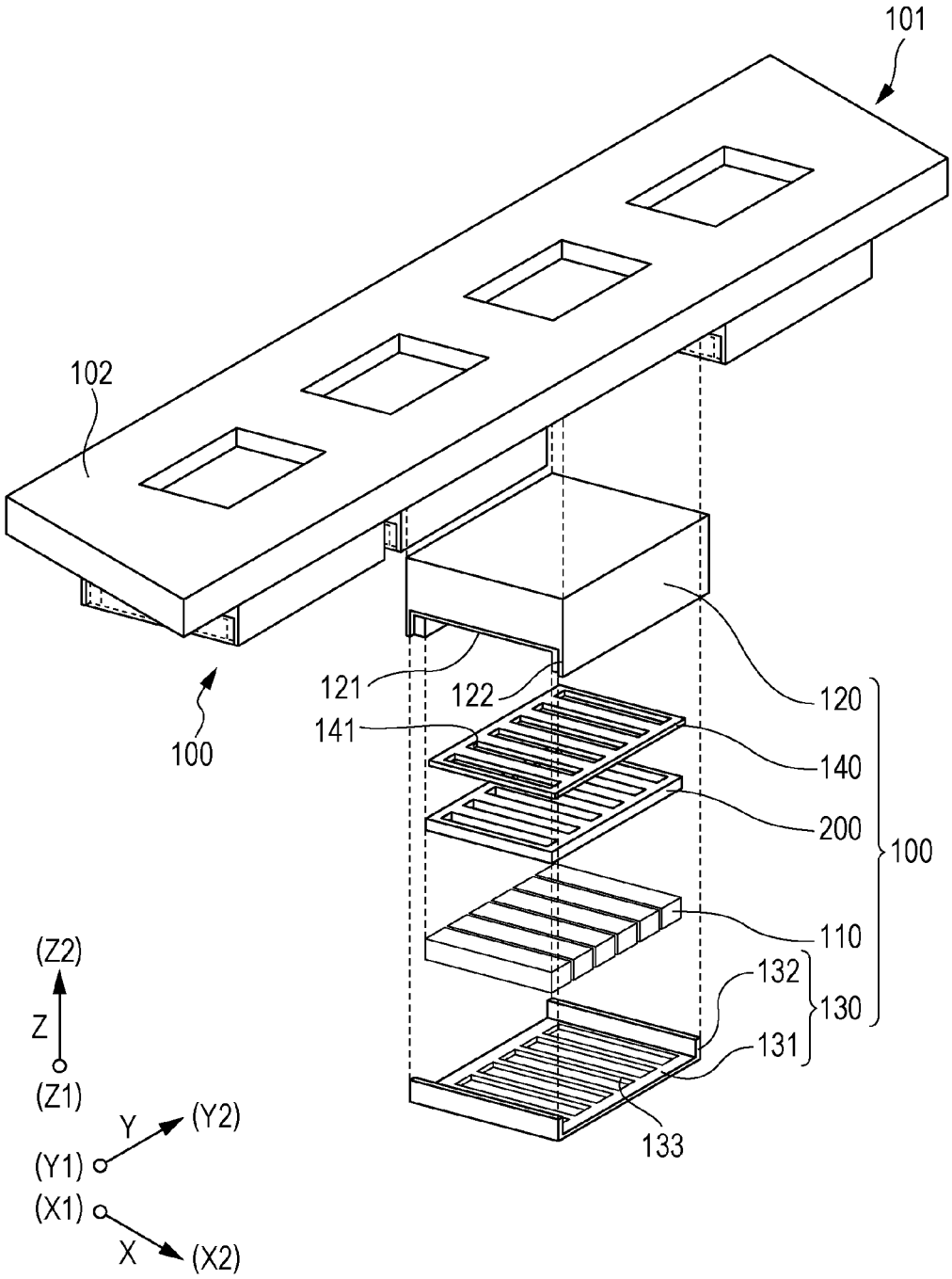
FIG. 2 is an exploded perspective view of a head unit according to Embodiment 1 of the invention.
Figure 3:
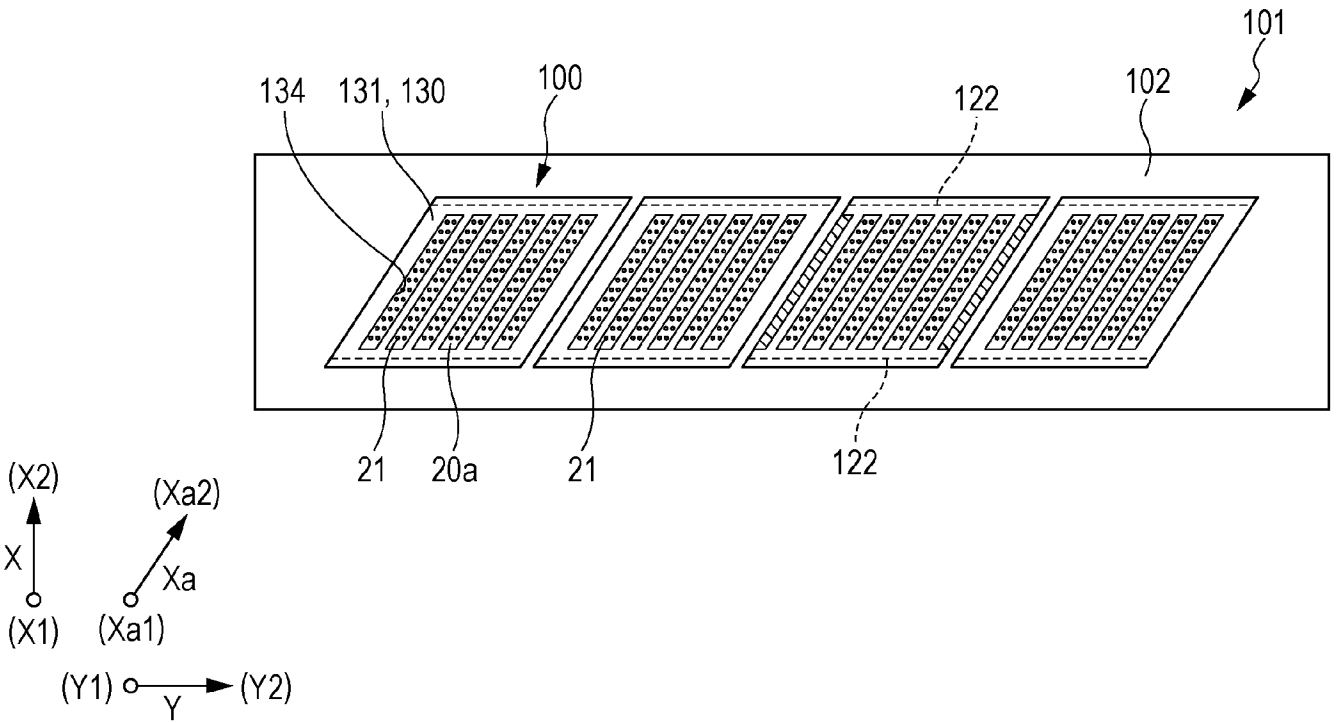
FIG. 3 is a bottom view of the head unit according to Embodiment 1 of the invention.

Details of the head unit 101 will be described with reference to FIGS. 2 and 3. FIG. 2 is an exploded perspective view illustrating the head unit according to this embodiment and FIG. 3 is a bottom view of the head unit, when viewed from the liquid ejection surface side.

The head unit 101 of this embodiment includes a plurality of recording heads 100 and the head fixing substrate 102 which holds the plurality of recording heads 100. In the recording head 100, a liquid ejection surface 20*a* in which the nozzle openings 21 are formed is provided on the Z1 side in the Z direction. Each recording head 100 is fixed to a surface of the head fixing substrate 102, which is the surface facing the recording sheet S. In other words, the recording head 100 is fixed to the Z1 side, that is, the side facing the recording sheet S, of the head fixing substrate 102 in the Z direction.

As described above, the plurality of recording heads 100 are fixed to the head fixing substrate 102, in a state where the recording heads 100 are aligned on a straight line extending in the Y direction perpendicular to the X direction which is the transporting direction. In other words, the plurality of recording heads 100 are arranged so as not to be shifted toward the X direction. Accordingly, the X-direction width of the head unit 101 is reduced, and thus it is possible to reduce the size of the head unit 101. Needless to say, the recording heads 100 aligned in the Y direction may be arranged to be shifted toward the X direction. However, in this case, when the recording heads 100 are greatly shifted toward the X direction, for example, the X-direction width of the head fixing substrate 102 increases. When the X-direction size of the head unit 101 increases, as described above, the X-direction distance between the first transport roller 5 and the second transport roller 6 increases in the ink jet type recording apparatus 1. As a result, it is difficult to fix the posture of the recording sheet S. In addition, the size of the head unit 101 and the ink jet type recording apparatus 1 increases.

In this embodiment, four recording heads 100 are fixed to the head fixing substrate 102. However, the configuration is not limited thereto, as long as the number of recording heads 100 is two or more.

Figure 4:
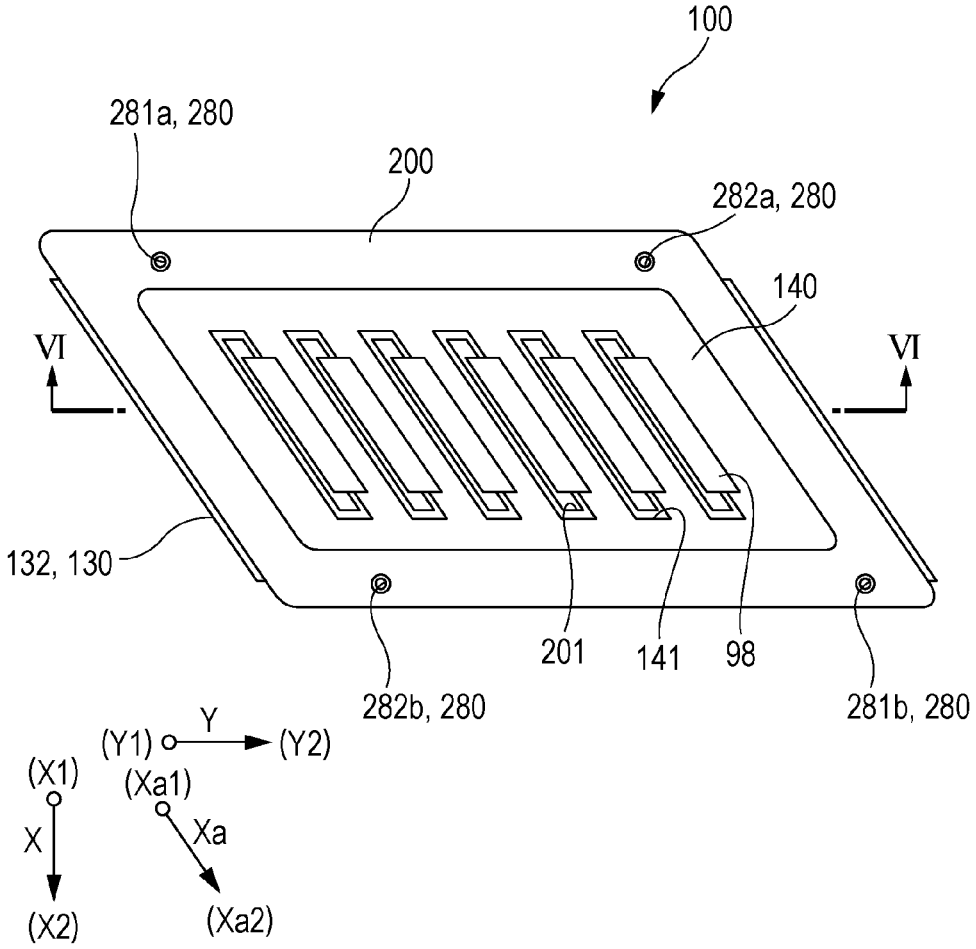
FIG. 4 is a plan view of a recording head according to Embodiment 1 of the invention.
Figure 5:
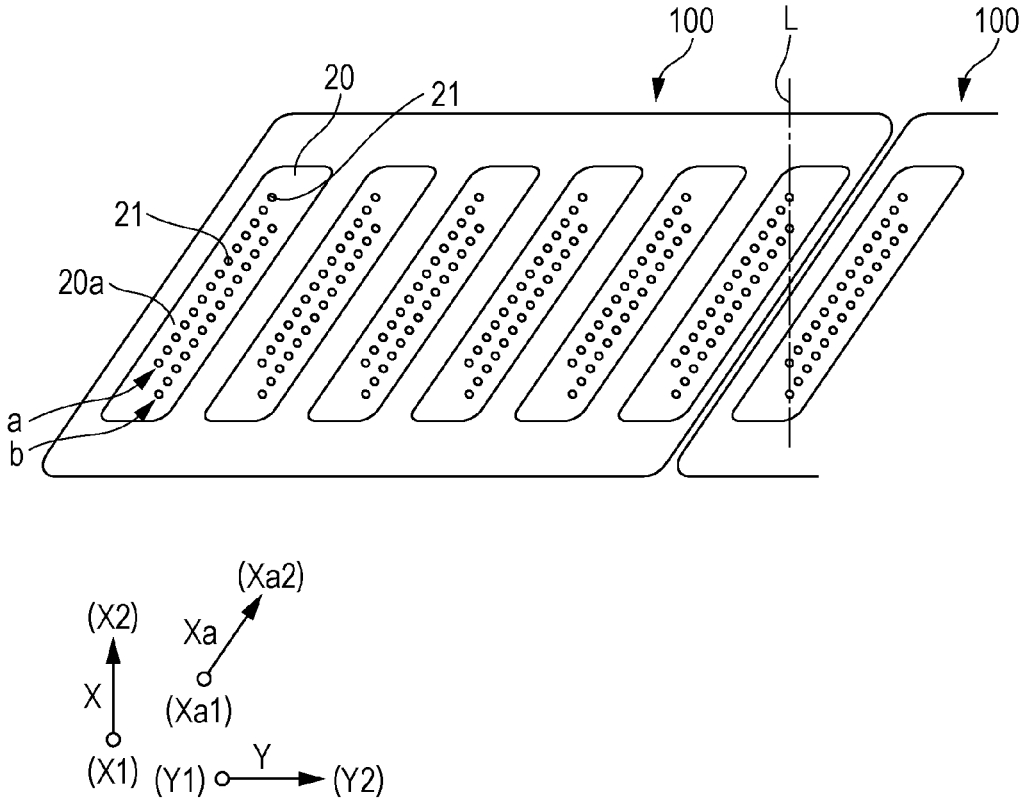
FIG. 5 is a bottom view of the recording head according to Embodiment 1 of the invention.
Figure 6:
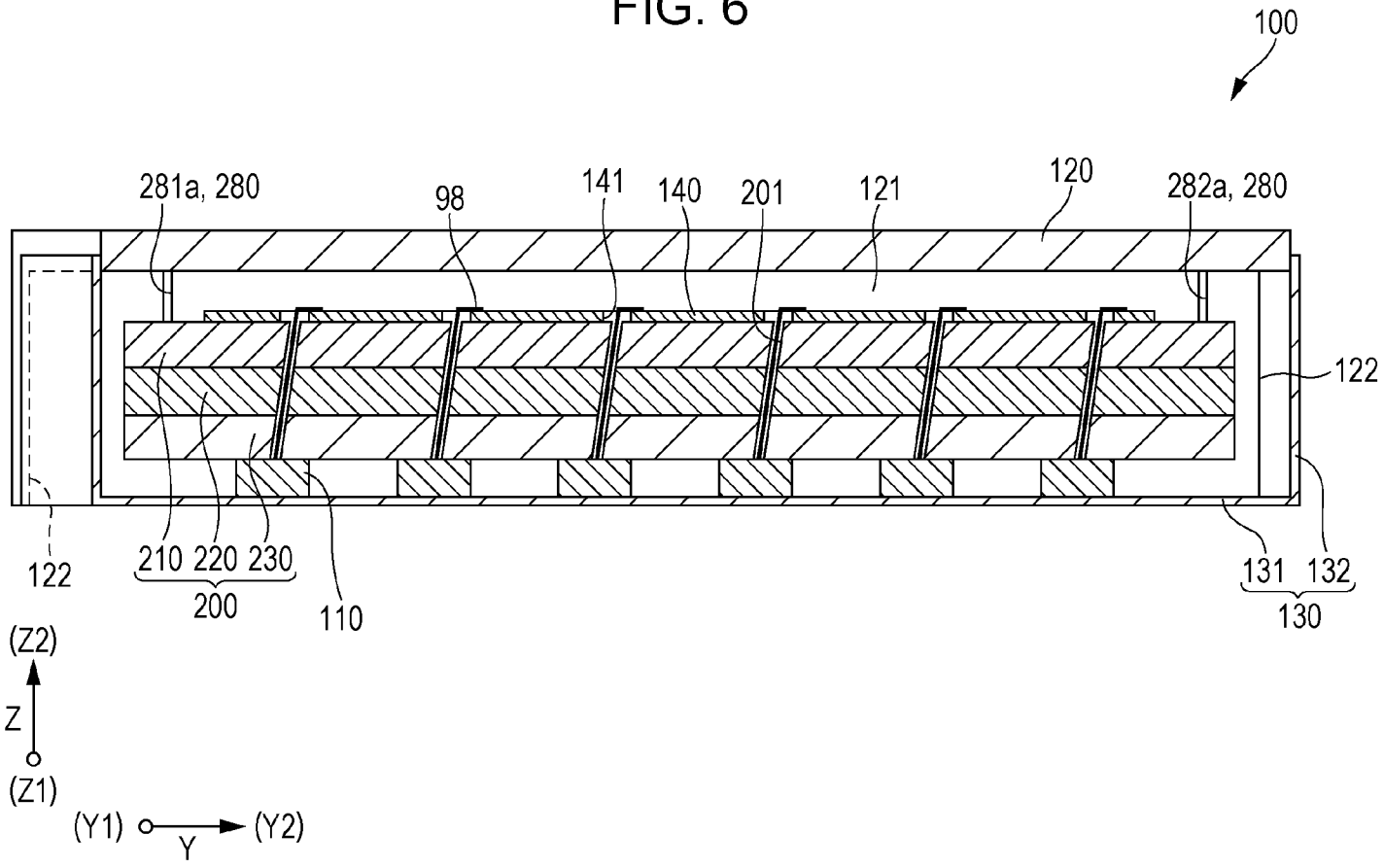
FIG. 6 is a cross-sectional view of FIG. 4, taken along a line VI-VI.

Next, the recording head 100 will be described with reference to FIG. 2 and FIGS. 4 to 6. FIG. 4 is a plan view of the recording head and FIG. 5 is a bottom view of the recording head. FIG. 6 is a cross-sectional view of FIG. 4, taken along a line VI-VI. FIG. 4 is a plan view of the recording head 100, when viewed from the Z2 side in the Z direction. A holding member 120 is not illustrated in FIG. 4.

The recording head 100 includes the plurality of head main bodies 110, COF substrates 98, and a flow-path member 200. The COF substrates 98 are respectively connected to the head main bodies 110. Flow paths through which ink is supplied to respective head main bodies are provided in the flow-path member 200. Furthermore, in this embodiment, the recording head 100 includes the holding member 120, a fixing plate 130, and a relay substrate 140. The holding member 120 holds the plurality of head main bodies 110. The fixing plate 130 is provided on the liquid ejection surface 20*a* side of the head main body 110.

The head main body 110 receives ink from the holding member 120 and the flow-path member 200 in which ink flow paths are provided. Control signals are transmitted from a controller (not illustrated) in the ink jet type recording apparatus 1 to the head main body 110, via both the relay substrate 140 and the COF substrate 98 and the head main body 110 discharges ink droplets in accordance with the control signals. Details of the configuration of the head main body 110 will be described below.

In each head main body 110, the liquid ejection surface 20*a* in which nozzle openings 21 are formed is provided on the Z1 side in the Z direction. Z2 sides of the plurality of head main bodies 110 adhere to the Z1-side surface of the flow-path member 200.

Liquid flow paths of ink supplied to the head main body 110 are provided in the flow-path member 200. The plurality of head main bodies 110 adhere to the Z1-side surface of the flow-path member 200, in a state where the plurality of head main bodies 110 are aligned in the Y direction. Details of the configuration of the flow-path member 200 will be described below. The liquid flow paths in the flow-path member 200 communicate with liquid flow paths of the respective head main bodies 110, in such a manner that ink is supplied from the flow-path member 200 to the respective head main bodies 110.

In this embodiment, six head main bodies 110 adhere to one flow-path member 200. However, the number of head main bodies 110 fixed to one flow-path member 200 is not limited to six. One head main body 110 may be fixed to each flow-path member 200 or two or more head main bodies 110 may be fixed to each flow-path member 200.

An opening portion 201 is provided in the flow-path member 200, in a state where the opening portion 201 passes through the flow-path member 200 in the Z direction. The COF substrate 98 of which one end is connected to the head main body 110 is inserted through the opening portion 201.

The COF substrate 98 is an example of a flexible wiring substrate. A flexible wiring substrate is a flexible substrate having wiring formed thereon. Furthermore, the COF substrate 98 includes a driving circuit 97 (see FIG. 7) which drives a pressure generation unit in the head main body 110.

The relay substrate 140 is a substrate on which electrical components, such as wiring, an IC, and a resistor, are mounted. The relay substrate 140 is disposed in a portion between the holding member 120 and the flow-path member 200. A passing-through portion 141 communicating with the opening portion 201 in the flow-path member 200 is formed in the relay substrate 140. The size of the opening of each passing-through portion 141 is greater than that of the opening portion 201 of the flow-path member 200.

The COF substrate 98 connected to the pressure generation unit of the head main body 110 is inserted through both the opening portion 201 and the passing-through portion 141. The COF substrate 98 is connected to a terminal (not illustrated) in the Z2-side surface of the relay substrate 140. In other words, the COF substrates 98 are respectively connected to the head main bodies 110. The COF substrate 98 extends from the Z1 side to the Z2 side in the Z direction. Furthermore, when viewed from the Y direction, all of the COF substrates 98 connected to the plurality of head main bodies 110 overlap each other. Although the COF substrate 98 of this embodiment is inclined, the lead electrode 90 and the relay substrate 140 which are electrically connected to the COF substrate 98 are arranged apart from each other in the Z direction, as described below. Thus the meaning of "the COF substrate 98 extends in the Z direction" includes the case in which the COF substrate 98 is inclined, as described above.

Although not particularly illustrated, the relay substrate 140 is connected to the controller of the ink jet type recording apparatus 1. Accordingly, for example, the driving signals sent from the controller are transmitted, through the relay substrate 140, to the driving circuit 97 of the COF substrate 98. The pressure generation unit of the head main body 110 is driven by the driving circuit 97. Therefore, an ink ejection operation of the recording head 100 is controlled.

On the Z1 side of the holding member 120, a hold portion 121 is provided to form a space having a groove shape. On the Z1-side surface of the holding member 120, the hold portion 121 continuously extends in the Y direction, and thus the hold portion 121 is open to both side surfaces of the holding member 120 in the Y direction. Furthermore, the hold portion 121 is provided in a substantially central portion of the holding member 120 in the X direction, and thus leg portions 122 are formed on both sides of the hold portion 121 in the X direction. In other words, in the Z1-side surface of the holding member 120, the leg portions 122 are provided on only both end portions in the X direction and are not provided on both end portions in the Y direction. In this embodiment, the holding member 120 is constituted of one member. However, the configuration of the holding member 120 is not limited thereto. The holding member 120 may be constituted of a plurality of members stacked in the Z direction.

The relay substrate 140, the flow-path member 200, and the plurality of head main body 110 are accommodated in such a hold portion 121. Specifically, the respective head main bodies 110 are bonded to the Z1-side surface of the flow-path member 200, using, for example, an adhesive. Furthermore, the relay substrate 140 is fixed to the Z2-side surface of the flow-path member 200. The relay substrate 140, the flow-path member 200, and the plurality of head main bodies 110 which are bonded into a single member are accommodated in the hold portion 121.

In the holding member 120 and the flow-path member 200, the Z-direction facing surfaces of the hold portion 121 and the flow-path member 200 adhere to each other, using an adhesive. The relay substrate 140 is accommodated in a space between the hold portion 121 and the flow-path member 200. The holding member 120 and the flow-path member 200 may be integrally fixed using a fixing unit, such as a screw, instead of using an adhesive.

Although not particularly illustrated, a flow path through which ink flows, a filter which filters out, for example, foreign matter, and the like may be provided in the holding member 120. The flow path of the holding member 120 communicates with the liquid flow path of the flow-path member 200. Accordingly, the ink fed from the liquid storage unit in the ink jet type recording apparatus 1 is supplied to the head main body 110 via both the holding member 120 and the flow-path member 200.

The fixing plate 130 is provided on the liquid ejection surface 20*a* side of the recording head 100. In other words, the fixing plate 130 is provided on the Z1 side of the recording head 100 in the Z direction and holds the respective recording heads 100. The fixing plate 130 is formed by bending a plate-shaped member constituted of, for example, metal. Specifically, the fixing plate 130 includes a base portion 131 and bent portions 132. The base portion 131 is provided on the liquid ejection surface 20*a* side of the fixing plate 130. Both end portions of the base portion 131 in the Y direction are bent in the Z2 direction, in such a manner that the bent portions 132 are formed.

Exposure opening portions 133 are provided in the base portion 131. The exposure opening portions 133 are openings for exposing the nozzle openings 21 of the respective head main bodies 110. In this embodiment, the exposure opening portions 133 are open in a state where the exposure opening portions 133 separately respectively correspond to the head main bodies 110. In other words, the recording head 100 of this embodiment has the six head main bodies 110, and thus six separate exposure opening portions 133 are provided in the base portion 131. Needless to say, one common exposure opening portion 133 may be provided with respect to a head main body group constituted of a plurality of head main bodies 110, in accordance with, for example, the configuration of the head main body 110.

The Z1 side of the hold portion 121 of the holding member 120 is covered with such a base portion 131. The base portion 131 is bonded, using an adhesive, to the Z1-side surface of the holding member 120 in the Z direction, in other words, the Z1-side end surfaces of the leg portion 122, as illustrated in FIG. 6.

The bent portions 132 are provided on both end portions of the base portion 131 in the Y direction. The bent portions 132 have a size which is capable of covering the opening areas of the hold portion 121, which are open in the Y-direction side surfaces of the hold portion 121. In other words, the bent portion 132 is a portion extending from the Y-direction end portion of the base portion 131 to the edge portion of the fixing plate 130. In addition, such a bent portion 132 is bonded, using an adhesive, to the Y-direction side surface of the holding member 120. Accordingly, the openings of the hold portion 121, which are open in the Y-direction side surfaces of the hold portion 121, are covered and sealed with the bent portions 132.

The fixing plate 130 adheres, using an adhesive, to the holding member 120, as described above, and thus the head main body 110 is disposed in the inner portion of the hold portion 121, which is a space between the holding member 120 and the fixing plate 130.

The plurality of head main bodies 110 are provided in each recording head 100, in such a manner that the recording head 100 of this embodiment has a plurality of nozzle rows, as described above. In this case, it is possible to improve a yield, compared to in a case where a plurality of nozzle rows are provided in only one head main body 110, in such a manner that one recording head 100 has a plurality of nozzle rows. In other words, when a plurality of nozzle rows are provided by one head main body 110, the yield of the head main body 110 decreases and a manufacturing cost increases. In contrast, when a plurality of nozzle rows are provided by a plurality of head main bodies 110, the yield of the head main body 110 is improved and the manufacturing cost can be reduced.

The openings in the Y-direction side surfaces of the holding member 120 are sealed with the bent portions 132 of the fixing plate 130. Accordingly, even when leg portions 122 which adhere to the base portion 131 of the fixing plate 130 are not provided on both sides (which are hatched portions in FIG. 3) of the holding member 120 in the Y direction, it is possible to prevent moisture evaporation from occurring through the openings in the Y-direction side surfaces of the hold portion 121.

Accordingly, in the head unit 101 in which the recording heads 100 are aligned in the Y direction, a gap between adjacent recording heads 100 in the Y direction can be reduced because the leg portions 122 are not provided on the Y-direction sides of the adjacent recording heads 100. Accordingly, the head main bodies 110 of adjacent recording heads 100 in the Y direction can be arranged close to each other, and thus the nozzle openings 21 of the respective head main bodies 110 of the adjacent recording heads 100 can be arranged close to each other in the Y direction.

In the recording head 100 according to this embodiment, the leg portions 122 are provided on both sides of the holding member 120 in the X direction. However, the leg portions 122 may not be provided. In other words, the head main body 110 may adhere to the Z1-side surface of the holding member 120 and the bent portions 132 may be provided on both sides of the fixing plate 130 in the X direction and on both sides thereof in the Y direction. That is, the bent portions 132 may be provided over the circumference of the fixing plate 130, in an in-plane direction of the liquid ejection surface 20*a*, and the fixing plate 130 adheres over the circumference of the side surfaces of the holding member 120. However, when the leg portions 122 are provided on both sides of the holding member 120 in the X direction, as in the case of this embodiment, the Z1-side end surfaces of the leg portion 122 adhere to the base portion 131 of the fixing plate 130. As a result, the hardness of the ink jet type recording head 100 in the Z direction can be improved and it is possible to prevent moisture evaporation from occurring through the leg portions 122.

Figure 7:
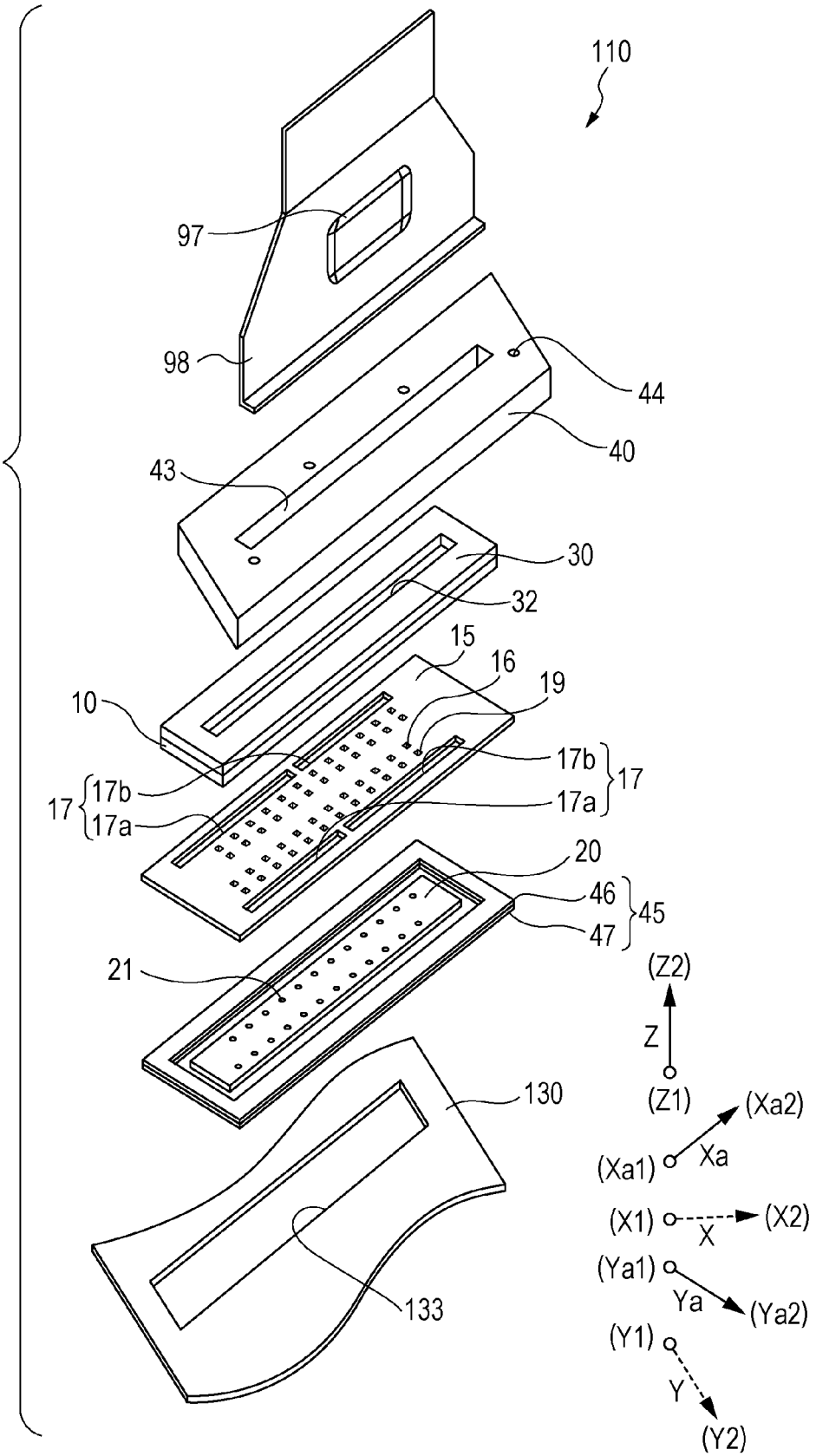
FIG. 7 is an exploded perspective view of a head main body according to Embodiment 1 of the invention.
Figure 8:
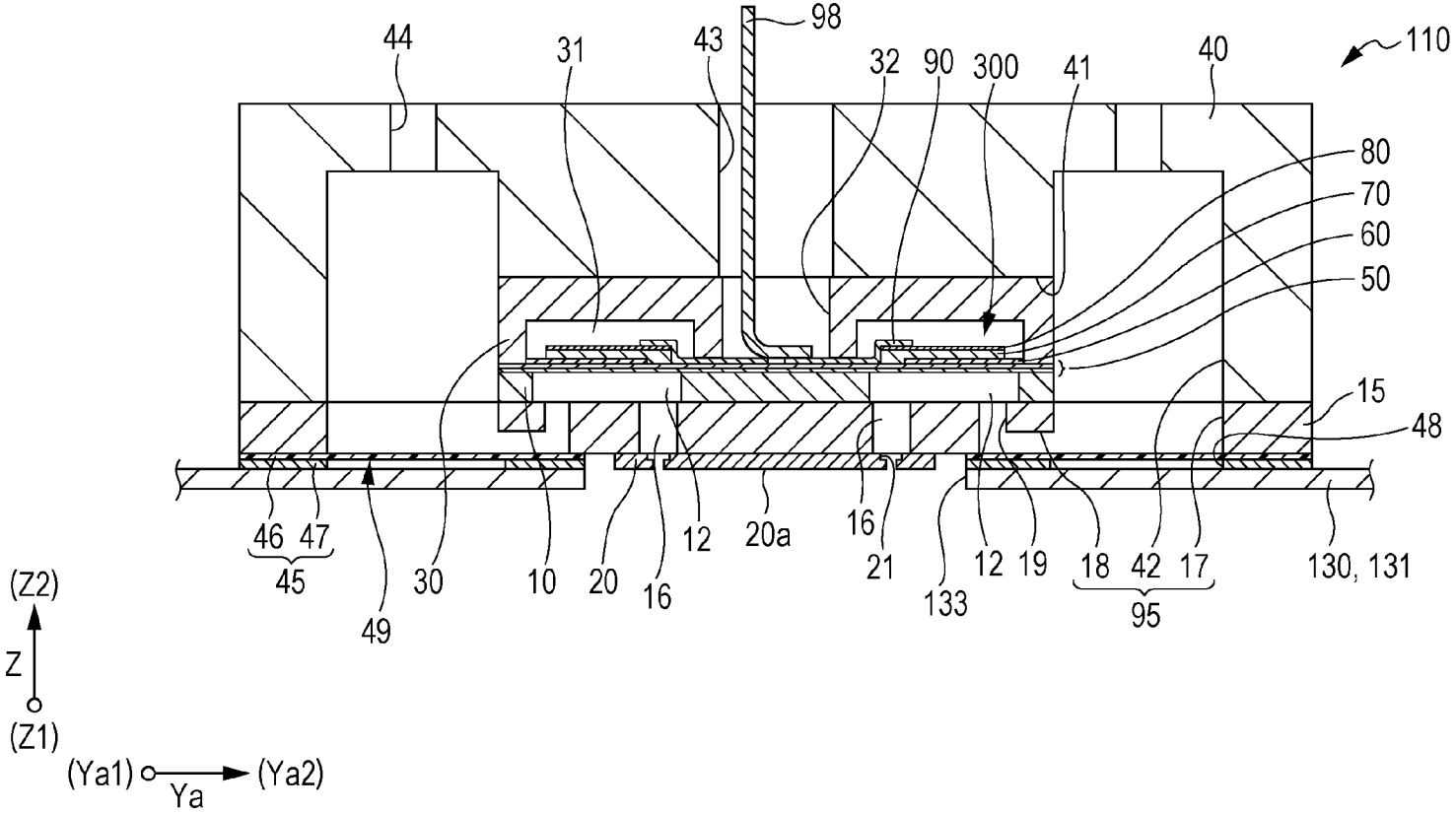
FIG. 8 is a cross-sectional view of the head main body according to Embodiment 1 of the invention.

The head main body 110 will be described with reference to FIGS. 7 and 8. FIG. 7 is a perspective view of the head main body according to this embodiment and FIG. 8 is a cross-sectional view of the head main body, taken along a line extending in the Y direction. Needless to say, the configuration of the head main body 110 is not limited to the configuration described below.

The head main body 110 of this embodiment includes a pressure generation chamber 12, the nozzle openings 21, a manifold 95, the pressure generation unit, and the like. Therefore, a plurality of members, such as a flow-path forming substrate 10, a communication plate 15, a nozzle plate 20, a protection substrate 30, a compliance substrate 45, a case 40 and the like are bonded to one another, using, for example, an adhesive.

One surface side of the flow-path forming substrate is subjected to anisotropic etching, in such a manner that a plurality of pressure generation chambers 12 partitioned by a plurality of partition walls are provided in the flow-path forming substrate 10, in a state where the pressure generation chambers 12 are aligned in an alignment direction of a plurality of the nozzle openings 21. In this embodiment, the alignment direction of the pressure generation chambers 12 is referred to as the Xa direction. Furthermore, a plurality (two, in this embodiment) of rows, each of which is constituted of the pressure generation chambers 12 aligned in the Xa direction, are provided in the flow-path forming substrate 10. A row-alignment direction in which a plurality of rows of the pressure generation chambers 12 are aligned will be referred to as a Ya direction. In this embodiment, a direction perpendicular to both the Xa direction and the Ya direction is parallel to the Z direction. Furthermore, the head main body 110 of this embodiment is mounted on the head unit 101, in a state where the Xa direction as an alignment direction of the nozzle openings 21 is inclined with respect to the X direction as the transporting direction of the recording sheet S.

For example, a supply path of which the opening area is smaller than that of the pressure generation chamber and which imparts a flow-path resistance to the ink flowing to the pressure generation chamber 12 may be provided in the flow-path forming substrate 10 in one end side of the Ya direction of the pressure generation chamber 12.

The communication plate 15 is bonded to one surface side of the flow-path forming substrate 10. Furthermore, the nozzle plate 20 in which a plurality of nozzle openings communicating with the respective pressure generation chambers 12 are provided is bonded to the communication plate 15. In this embodiment, the Z1 side of the nozzle plate 20, on which the nozzle openings 21 are open, is the liquid ejection surface 20*a*.

A nozzle communication path 16 which allows the pressure generation chamber 12 to communicate with the nozzle opening 21 is provided in the communication plate 15. The area of the communication plate 15 is greater than that of the flow-path forming substrate 10 and the area of the nozzle plate 20 is smaller than that of the flow-path forming substrate 10. The nozzle plate 20 has a relatively small area, as described above. As a result, it is possible to achieve a reduction in costs.

A first manifold 17 and a second manifold 18 which constitute a part of the manifold 95 is provided in the communication plate 15. The first manifold 17 passes through the communication plate 15 in the Z direction. The second manifold 18 does not pass through the communication plate 15 in the Z direction. The second manifold 18 is open to the nozzle plate 20 side of the communication plate 15 and extends to the Z-direction middle portion of the nozzle plate 20.

Supply communication paths 19 which communicate with respective end portions of the pressure generation chambers 12 in the Y direction is provided in the communication plate 15, in a state where the supply communication paths 19 separately respectively correspond to the pressure generation chambers 12. The supply communication path 19 allows the second manifold 18 to communicate with the pressure generation chamber 12.

The nozzle openings 21 which respectively communicate with the pressure generation chambers 12 through the nozzle communication path 16 are formed in the nozzle plate 20. The plurality of nozzle openings 21 are aligned in the Xa direction. The aligned nozzle openings 21 form two nozzle rows which are a nozzle row a and a nozzle row b. The nozzle row a and the nozzle row b are aligned in the Ya direction. In this embodiment, each of the nozzle rows a and b is divided into two portions, and thus one nozzle row can eject liquids of two kinds. Details of this will be described below.

Meanwhile, a diaphragm 50 is formed on a surface of the flow-path forming substrate 10, which is the surface on the side opposite to the communication plate 15 of the flow-path forming substrate 10. A first electrode 60, a piezoelectric layer 70, and a second electrode 80 are laminated, in order, on the diaphragm 50, in such a manner that a piezoelectric actuator 300 as the pressure generation unit of this embodiment is constituted. Generally, one electrode of the piezoelectric actuator 300 is constituted of a common electrode. The other electrodes and the piezoelectric layers are subjected to patterning such that the other electrode and the piezoelectric layer correspond to each pressure generation chamber 12.

The protection substrate 30 having substantially the same size as that of the flow-path forming substrate 10 is bonded to a surface of the flow-path forming substrate 10, which is the surface on the piezoelectric actuator 300 side. The protection substrate 30 has a hold portion 31 which is a space for protecting the piezoelectric actuator 300. Furthermore, in the protection substrate 30, a through-hole 32 is provided in a state where the through-hole 32 passes through the protection substrate 30 in the Z direction. An end portion of a lead electrode 90 extending from the electrode of the piezoelectric actuator 300 extends such that the end portion is exposed to the inner portion of the through-hole 32. The lead electrode 90 and the COF substrate 98 are electrically connected in the through-hole 32.

Furthermore, the case 40 which forms manifolds 95 communicating with a plurality of pressure generation chambers 12 is fixed to both the protection substrate 30 and the communication plate 15. In a plan view, the case 40 and the communication plate 15 described above have the substantially the same shape. The case 40 is bonded to the protection substrate 30 and, further, bonded to the communication plate 15 described above. Specifically, a concave portion 41 is provided on the protection substrate 30 side of the case 40. The depth of the concave portion 41 is enough to accommodate both the flow-path forming substrate 10 and the protection substrate 30. The opening area of the concave portion 41 is greater than that of a surface of the protection substrate 30, which is the surface bonded to the flow-path forming substrate 10. An opening surface of the concave portion 41, which is the opening surface on the nozzle plate 20 side, is sealed with the communication plate 15, in a state where the flow-path forming substrate 10 and the like are accommodated in the concave portion 41. Accordingly, in the outer circumferential portion of the flow-path forming substrate 10, a third manifold 42 is formed by the case 40, the flow-path forming substrate 10, and the protection substrate 30. The manifold 95 of this embodiment is constituted of the third manifold 42, the first manifold 17, and the second manifold 18, in which the first manifold 17 and the second manifold 18 are provided in the communication plate 15. Liquids of two kinds can be ejected by one nozzle row, as described above. Thus, each of the first manifold 17, the second manifold 18, and the third manifold 42 which constitute the manifold 95 is divided into two portions, in a nozzle-row direction, that is, the Xa direction. The first manifold 17 is constituted of, for example, a first manifold 17*a* and a first manifold 17*b*, as illustrated in FIG. 7. Similarly, each of the second manifold 18 and the third manifold 42 is also divided into two portions. Thus, the entirety of the manifold 95 is divided into two portions, in the Xa direction.

In this embodiment, the first manifolds 17, the second manifolds 18, and the third manifolds 42 which constitute the manifolds 95 are symmetrically arranged with the nozzle rows a and b interposed therebetween. In this case, the nozzle row a and the nozzle row b can eject different liquids. Needless to say, the arrangement of the manifolds is not limited thereto.

In this embodiment, each of the manifolds corresponding to the respective nozzle rows is divided into two portions, in the Xa direction. Accordingly, in total, four manifolds 95 are provided such that liquids of four kinds can be ejected, as described below. However, manifolds may be provided corresponding to nozzle rows a and b. Alternatively, one common manifold may be provided with respect to the two rows which are the nozzle row a and the nozzle row b.

The compliance substrate 45 is provided in a surface of the communication plate 15, in which both the first manifold 17 and the second manifold 18 are open. The openings of both the first manifold 17 and the second manifold 18 are sealed with the compliance substrate 45.

In this embodiment, such a compliance substrate 45 includes a sealing film 46 and a fixing substrate 47. The sealing film 46 is constituted of a flexible thin film (which is formed of, for example, polyphenylene sulfide (PPS) or stainless steel (SUS)). The fixing substrate 47 is constituted of a hard material, for example, metal, such as stainless metal (SUS). A part of the fixing substrate 47, which is the portion facing the manifold 95, is completely removed in a thickness direction and forms an opening portion 48. Thus, one surface of the manifold 95 forms a compliance portion 49 which is a flexible portion sealed with only the sealing film 46 having flexibility.

The fixing plate 130 adheres to a surface of the compliance substrate 45, which is the surface on a side opposite to the communication plate 15. In other words, the opening area of the exposure opening portion 133 of the base portion 131 of the fixing plate 130 is a greater than the area of the nozzle plate 20. The liquid ejection surface 20*a* of the nozzle plate 20 is exposed through the exposure opening portion 133. Needless to say, the configuration is not limited thereto. The opening area of the exposure opening portion 133 of the fixing plate 130 may be smaller than that of the nozzle plate 20 and the fixing plate 130 may abut or adhere to the liquid ejection surface 20*a* of the nozzle plate 20. Alternatively, even when the opening area of the exposure opening portion 133 of the fixing plate 130 is smaller than that of the nozzle plate 20, the fixing plate 130 may be provided in a state where the fixing plate 130 is not in contact with the liquid ejection surface 20*a*. In other words, the meaning of "the fixing plate 130 is provided on the liquid ejection surface 20*a* side" includes both a state where the fixing plate 130 is not in contact with the liquid ejection surface 20*a* and a state where the fixing plate 130 is in contact with the liquid ejection surface 20*a*.

An introduction path 44 is provided in the case 40. The introduction path 44 communicates with the manifold 95 and allows ink to be supplied to the manifold 95. In addition, a connection port 43 is provided in the case 40. The connection port 43 communicates with the through-hole 32 of the protection substrate 30 and the COF substrate 98 is inserted therethrough.

In the head main body 110 configured as described above, when ink is ejected, ink is fed from a storage unit through the introduction path 44 and the flow path from the manifold 95 to the nozzle openings 21 is filled with the ink. Then, voltage is applied, in accordance with signals from the driving circuit 97, to each piezoelectric actuator 300 corresponding to the pressure generation chamber 12, in such a manner that the diaphragm, along with the piezoelectric actuator 300, is flexibly deformed. As a result, the pressure in the pressure generation chamber 12 increases, and thus ink droplets are ejected from predetermined nozzle openings 21.

Figure 9:
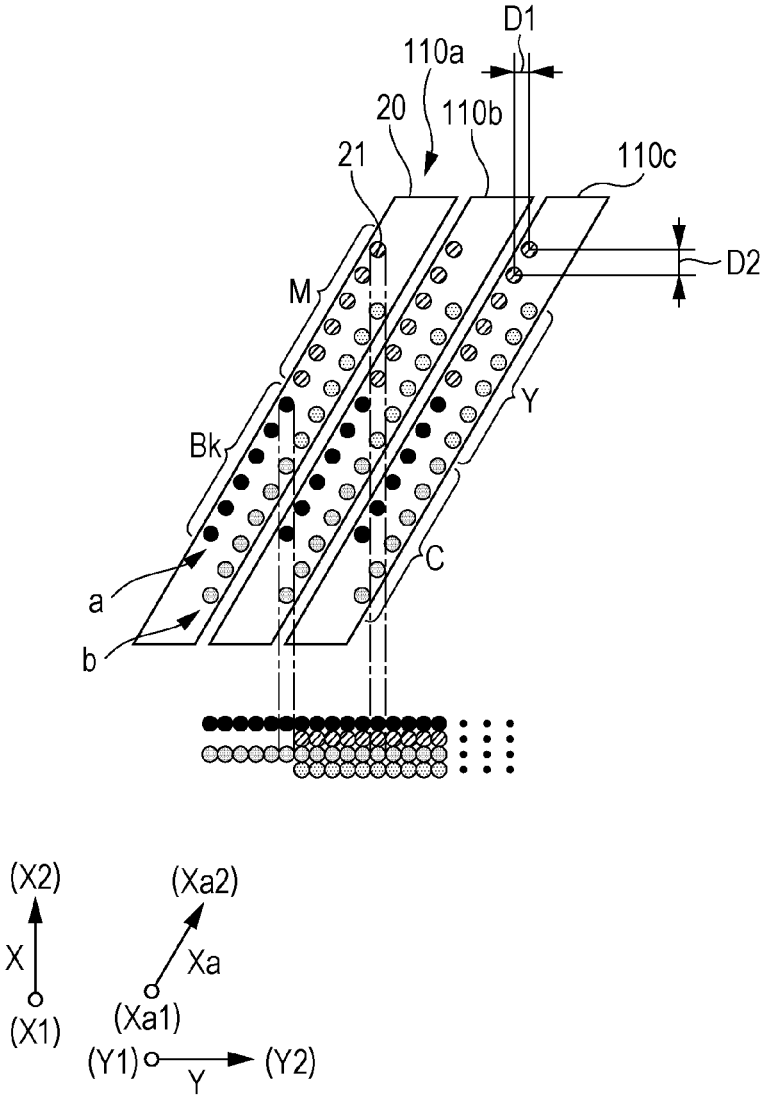
FIG. 9 is a schematic view illustrating the arrangement of nozzle openings of Embodiment 1 of the invention.

Here, details of the configuration in which the alignment direction of the nozzle openings 21 constituting the nozzle row of the head main body 110 is inclined with respect to the X direction as the transporting direction of the recording sheet S will be described with reference to FIGS. 5 and 9. FIG. 9 is a schematic view explaining the arrangement of the nozzle openings of the head main body according to this embodiment.

The plurality of the head main bodies 110 are fixed in a state where, in the in-plane direction of the liquid ejection surface 20*a*, the nozzle rows a and b are inclined with respect to the X direction as the transporting direction of the recording sheet S. The nozzle row referred to in this case is a row of a plurality of nozzle openings 21 aligned in a predetermined direction. In this embodiment, two rows which are the nozzle rows a and b, each of which is constituted of a plurality of nozzle openings 21 aligned in the Xa direction as the predetermined direction, are provided in the liquid ejection surface 20*a*. The Xa direction intersects the X direction at an angle greater than 0° and less than 90°. In this case, it is preferable that the Xa direction intersects the X direction at an angle greater than 0° and less than 45°. In this case, upon comparison with in the case where the Xa direction intersects the X direction at an angle greater than 45° and less than 90°, a gap D1 between adjacent nozzle openings 21 in the Y direction can be further reduced. As a result, the recording head 100 can have high definition in the Y direction. Needless to say, the Xa direction may intersect the X direction at an angle greater than 45° and less than 90°.

The meaning of "the Xa direction intersects the X direction at the angle greater than 0° and less than 45°" implies that, in the plane of the liquid ejection surface 20*a*, the nozzle row is inclined closer to the X direction than a straight line intersecting the X direction at 45°. The gap D1 referred to in this case is a gap between the nozzle openings 21 of the nozzle rows a and b, in a state where the nozzle openings 21 are projected in the X direction, with respect to an imaginary line in the Y direction. Furthermore, a gap between the nozzle openings 21 of the nozzle rows a and b which are projected in the Y direction, with respect to an imaginary line in the X direction, is set to a gap D2.

In this embodiment, liquids of two kinds can be ejected from one nozzle row and liquids of four kinds can be ejected from two nozzle rows, as illustrated in FIG. 9. In other words, when it is assumed that inks of four colors are used, a black ink Bk and a magenta ink M are can be ejected from the nozzle row a and a cyan ink C and a yellow ink Y can be ejected from the nozzle row b. Furthermore, the nozzle row a and the nozzle row b have the same number of nozzle openings 21. The Y-direction positions of the nozzle openings 21 of the nozzle row a and the Y-direction positions of the nozzle openings 21 of the nozzle row b overlap in the X direction.

Head main bodies 110*a* to 110*c* have the nozzle rows a and b. The head main bodies 110*a* to 110*b* are arranged close to each other in the Y direction, and thus the nozzle openings 21 of adjacent head main bodies 110 in the Y direction are aligned in a state where the nozzle openings 21 overlap in the X direction. Accordingly, a part of the nozzle row a of the head main body 110*a*, which is a portion ejecting the magenta ink M, and a part of the nozzle row b of the head main body 110*a*, which is a portion ejecting the yellow ink Y, overlap, in the X direction, with a part of the nozzle row a of the head main body 110*b*, which is a portion ejecting the black ink Bk, and a part of the nozzle row b of the head main body 110*b*, which is a portion ejecting the cyan ink C. Therefore, lines of four colors are aligned in one row in the X direction, and thus a color image can be printed. Similarly, in the case of adjacent head main bodies 110*b* and 110*c* in the Y direction, the nozzle openings 21 are aligned in a state where the nozzle openings 21 overlap in the X direction.

At least some of nozzle openings 21 of nozzle rows of adjacent head main bodies 110, which are the nozzle rows ejecting ink of the same color, overlap in the X direction. As a result, the image quality in a joining portion between the head main bodies 110 can be improved. In other words, one nozzle opening 21 of the nozzle row a of the head main body 110*a*, which is the nozzle row ejecting the magenta ink M, and one nozzle opening 21 of the nozzle row a of the head main body 110*b*, which is the nozzle row ejecting the magenta ink M, overlap in the X direction. Ejection operations through the two overlapping nozzle openings 21 are controlled, in such a manner that image quality deterioration, such as banding and streaks, can be prevented from occurring in the joining portion between the adjacent head main bodies 110. In an example illustrated in FIG. 9, only one nozzle opening 21 of one head main body 110 and one nozzle openings 21 of the other head main body 110 overlap in the X direction. However, two or more nozzle openings 21 of one head main body 110 and two or more nozzle openings 21 of the other head main body 110 may overlap in the X direction.

Needless to say, the arrangement relating to colors may not be limited thereto. Although not particularly illustrated, the black ink Bk, the magenta ink M, the cyan ink C, and the yellow ink Y can be ejected from, for example, one nozzle row.

As described above, the head unit 101 is constituted by fixing four recording heads 100 to the head fixing substrate 102, in which each recording head 100 has a plurality of head main bodies 110. Parts of nozzle rows of adjacent recording heads 100 overlap in the X direction, as illustrated by a straight line L in FIG. 5. In other words, similarly to the relationship between adjacent head main bodies 110 in one recording head 100, adjacent head main bodies 110 of adjacent recording heads 100 in the Y direction are arranged close to each other in the Y direction, and thus a color image can be printed in a portion between the adjacent recording heads 100 and, further, the image quality in the joining portion between the adjacent recording heads 100 can be improved. Needless to say, the number of overlapping nozzle openings 21 between adjacent recording heads 100, which overlap in the X direction, is not necessarily the same as the number of overlapping nozzle openings 21 between adjacent head main bodies 110 in one recording head 100, which overlap in the X direction.

As described above, the nozzle rows between adjacent head main bodies 110 the nozzle rows between adjacent recording heads 100 partially overlap in the X direction, and thus the image quality in the joining portion can be improved.

It is preferable that, in a portion between nozzle openings 21 of nozzle rows, which are adjacent in the Xa direction, a pitch between adjacent nozzles and the an angle between the X direction and the Xa direction are set to satisfy a condition in which the relationship between the gap D1 in the X direction and the gap D2 in the Y direction satisfies an integer ratio. In this case, when an image is printed in accordance with image data which is constituted of pixels having a matrix shape in which the pixels are arranged in both the X direction and the Y direction, it is easy to pair each nozzle with each pixel. Needless to say, the relationship is not limited to the relationship of an integer ratio.

In a plan view seen from the liquid ejection surface 20*a* side, the recording head 100 of this embodiment has a substantially parallelogram shape, as illustrated in FIG. 5. The reason for this is as follows. The Xa direction as the alignment direction of the nozzle openings 21 which constitute the nozzle rows a and b of each head main body 110 is inclined with respect to the X direction as the transporting direction of the recording sheet S. Furthermore, the recording head 100 is formed in a shape parallel to the Xa direction as an inclined direction of the nozzle row b. In other words, the fixing plate 130 has a substantially parallelogram shape. Needless to say, in a plan view seen from the liquid ejection surface 20*a* side, the shape of the recording head 100 is not limited to a substantially parallelogram. The recording head 100 may have a trapezoidal-rectangular shape, a polygonal shape, or the like.

An example in which two nozzle rows are provided in one head main body is described in the embodiment described above. However, needless to say, even when three or more nozzle rows are provided, the same effects described above may be obtained. Furthermore, when two nozzle rows are provided in one head main body 110, as in the case of this embodiment, nozzle openings 21 of the two nozzle rows can be arranged in a portion between two manifolds 95 respectively corresponding to the two nozzle rows, as illustrated in FIG. 8. Thus, a gap between the two nozzle rows in the Ya direction can be reduced, compared to in the case where nozzle openings 21 of a plurality of nozzle rows are arranged on the same side with respect to manifolds respectively corresponding to the plurality of nozzle rows. As a result, in the nozzle plate 20, the area required for providing two nozzle rows can be reduced. In addition, it is easy to connect the respective piezoelectric actuators 300 corresponding to two nozzle rows and the respective COF substrates 98.

In this embodiment, the nozzle row a and the nozzle row b have the same number of nozzle openings 21. Accordingly, in the nozzle rows, the same number of nozzle openings 21 can overlap in the X direction, and thus it is possible to effectively eject liquid. However, nozzle rows do not have necessarily the same number of nozzle openings. Furthermore, the nozzle rows a and b may eject liquids of the same kind. In other words, the nozzle rows a and b may eject, for example, ink of the same color.

In this embodiment, it is preferable that the head main body 110 has s nozzle plate 20 having two nozzle rows. In this case, nozzle rows can be arranged with higher precision. Needless to say, one nozzle row may be provided in each nozzle plate 20. The nozzle plate 20 is constituted of a stainless-steel (SUS) plate, a silicon substrate, or the like.

Figure 10:
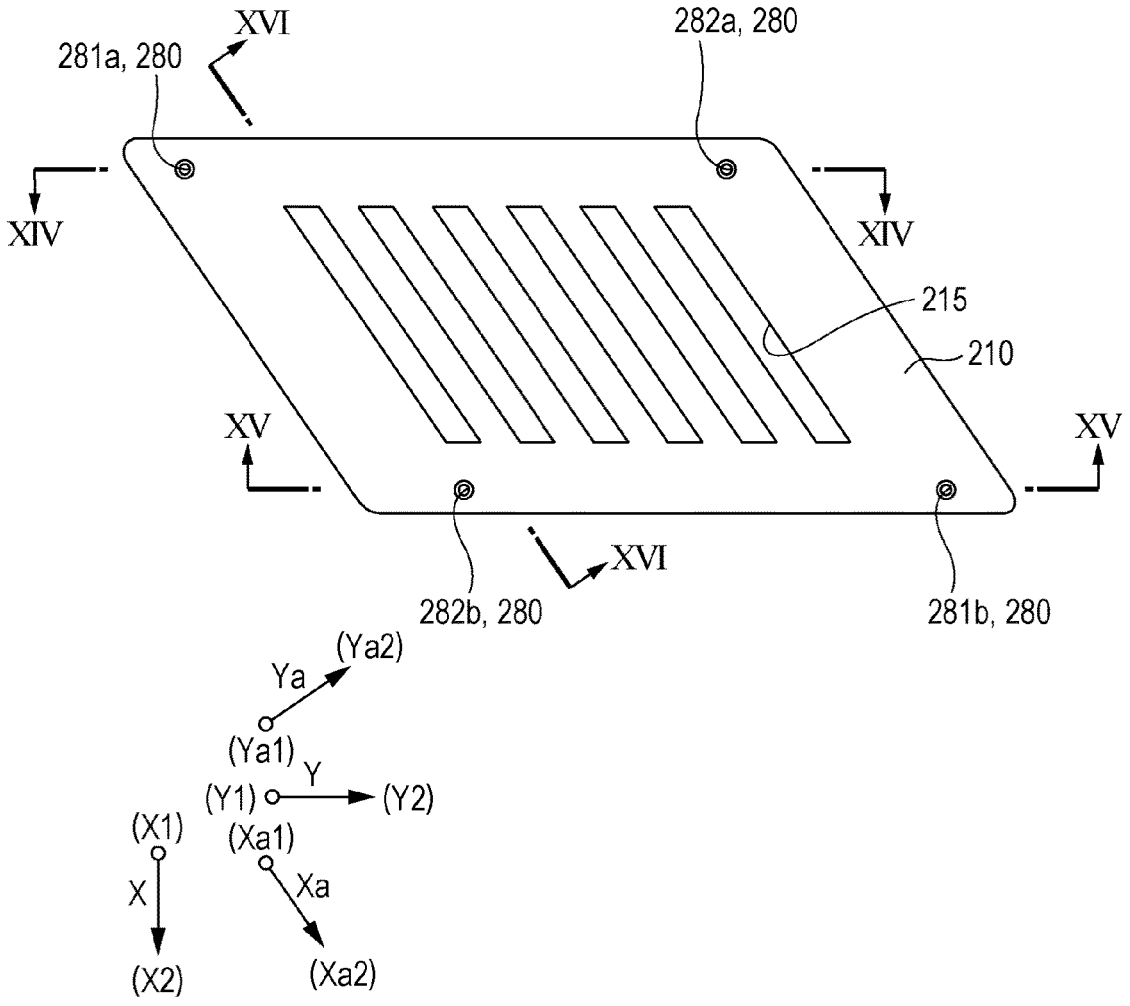
FIG. 10 is a plan view of a flow-path member (which is a first flow-path member) according to Embodiment 1 of the invention.
Figure 11:
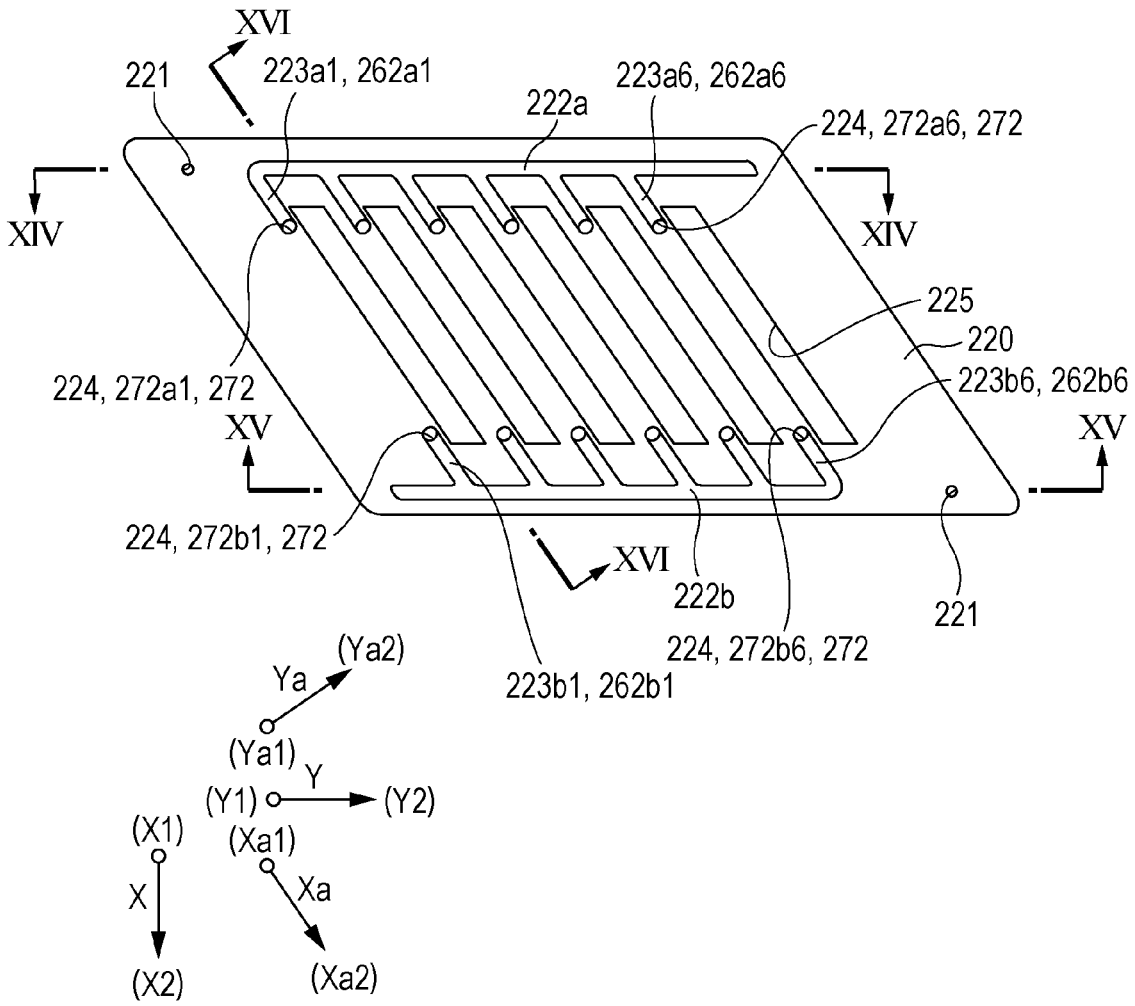
FIG. 11 is a plan view of a second flow-path member according to Embodiment 1 of the invention.
Figure 12:
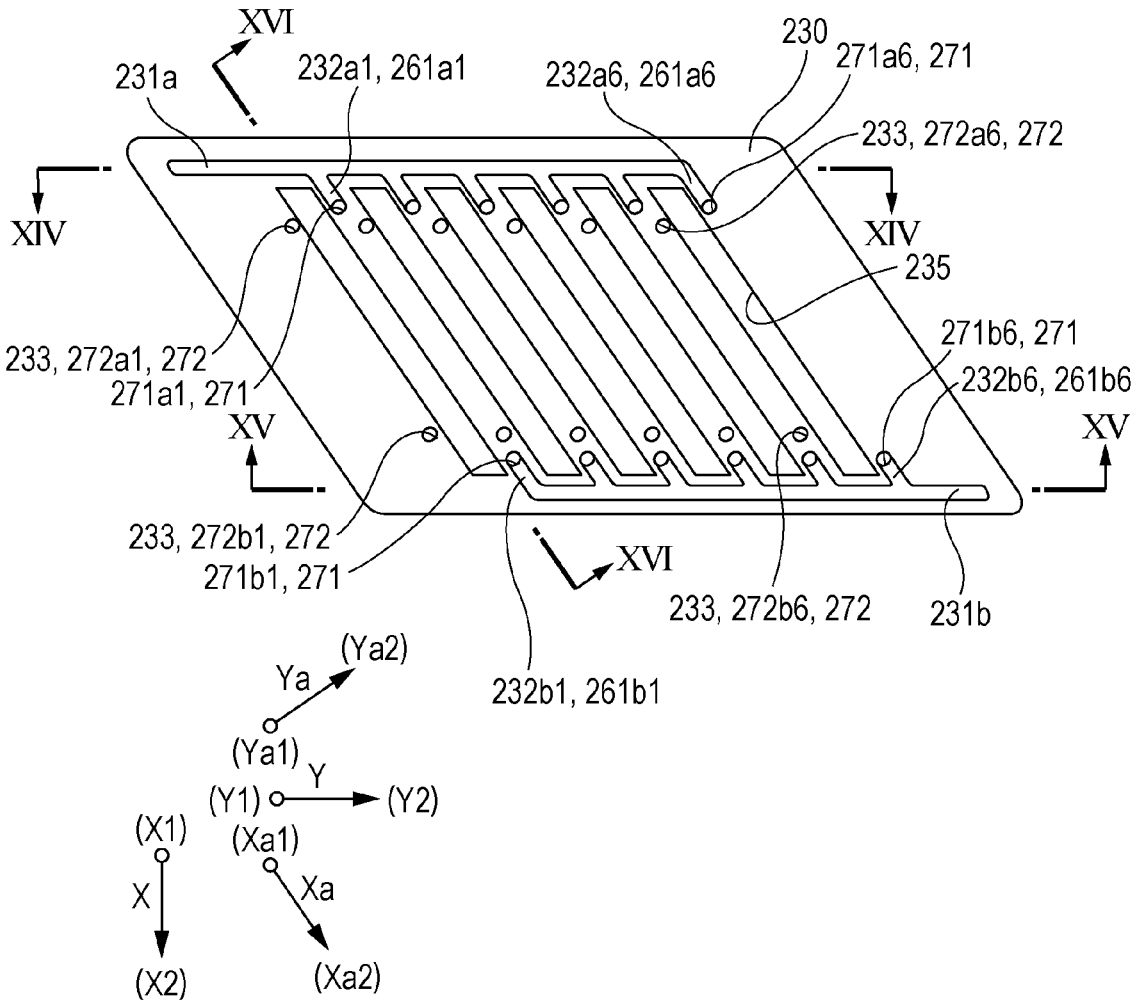
FIG. 12 is a plan view of a third flow-path member according to Embodiment 1 of the invention.
Figure 13:
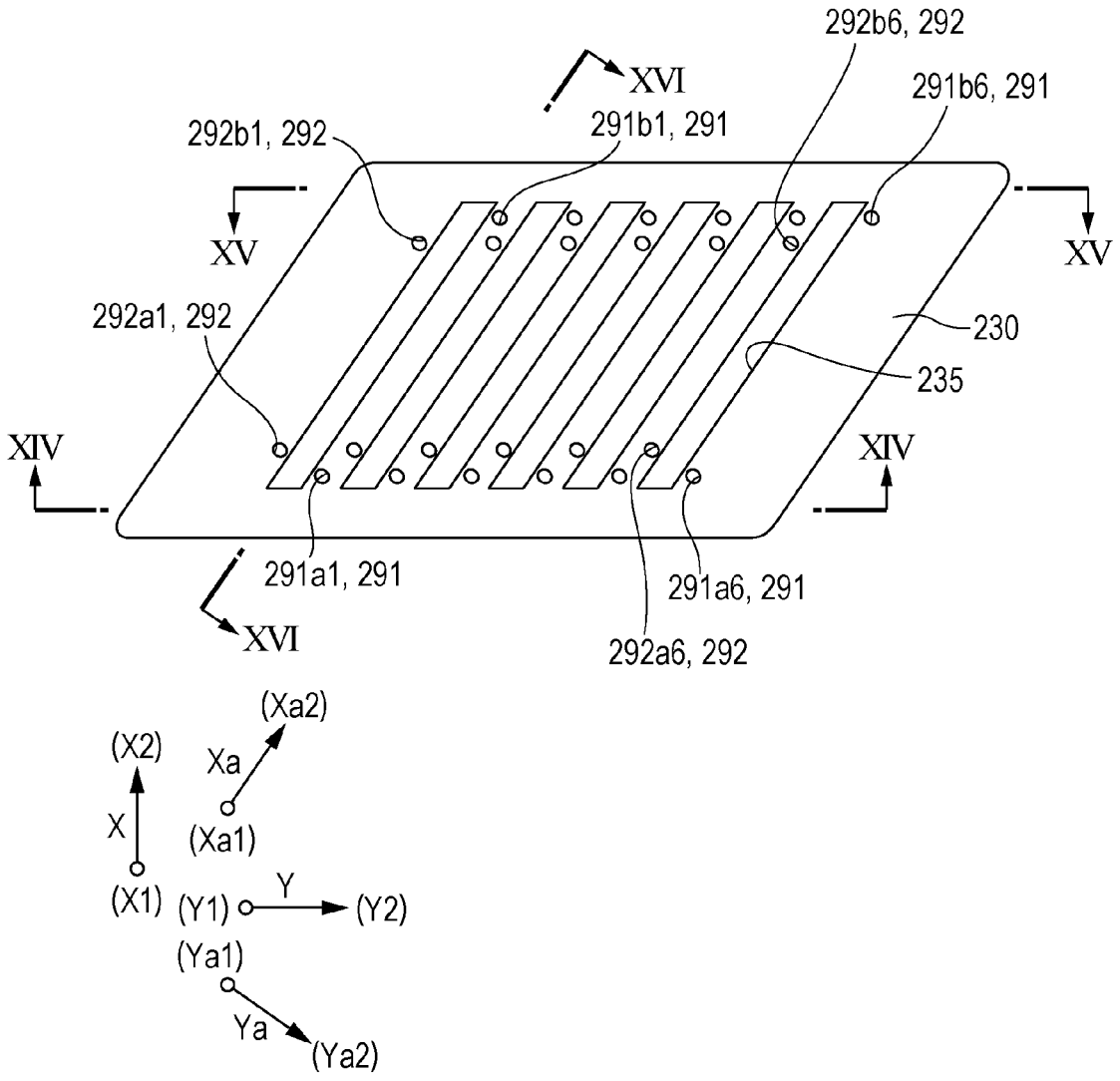
FIG. 13 is a bottom view of the third flow-path member according to Embodiment 1 of the invention.
Figure 14:
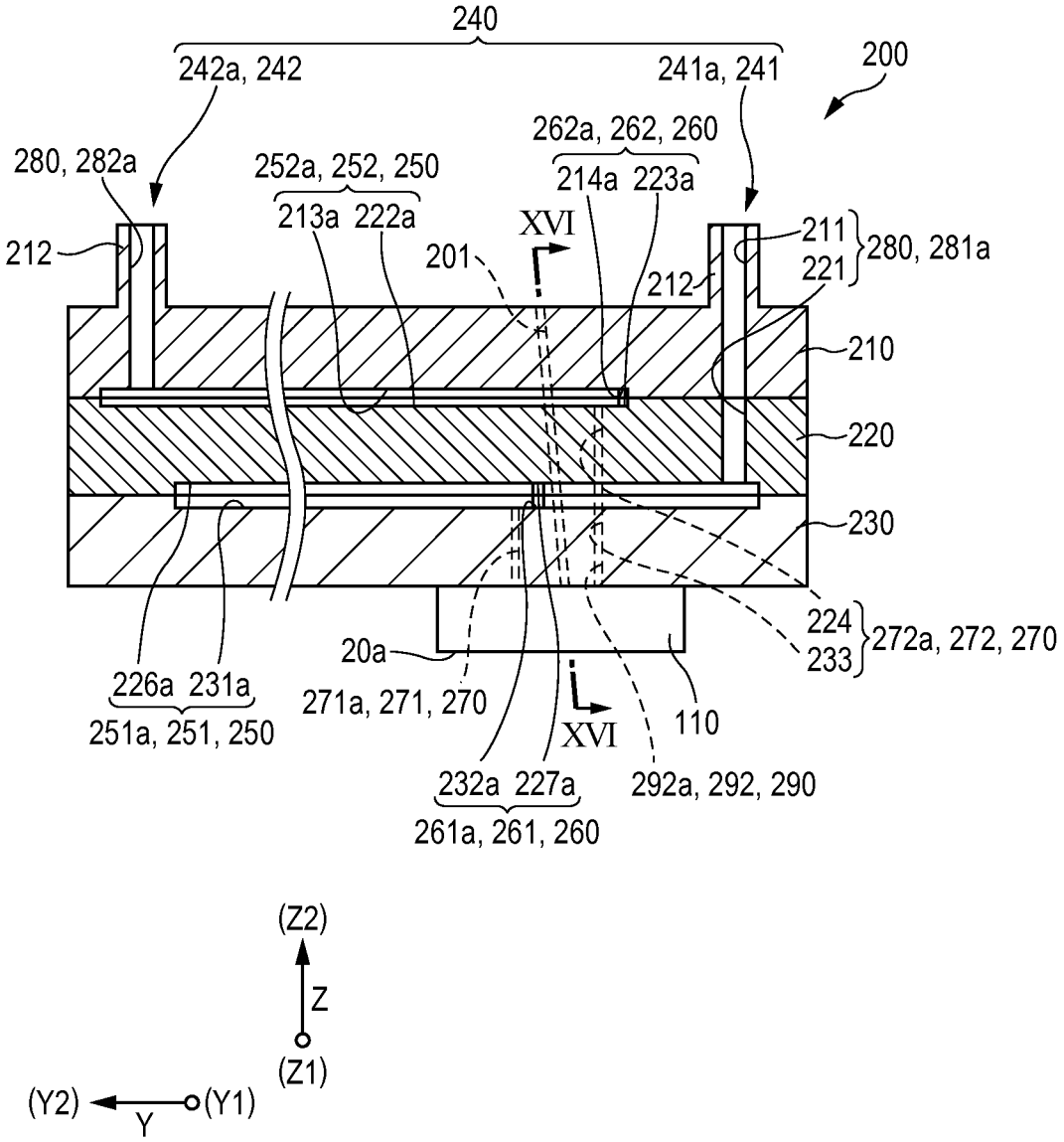
FIG. 14 is a cross-sectional view of FIGS. 10 to 13, taken along a line XIV-XIV.
Figure 15:
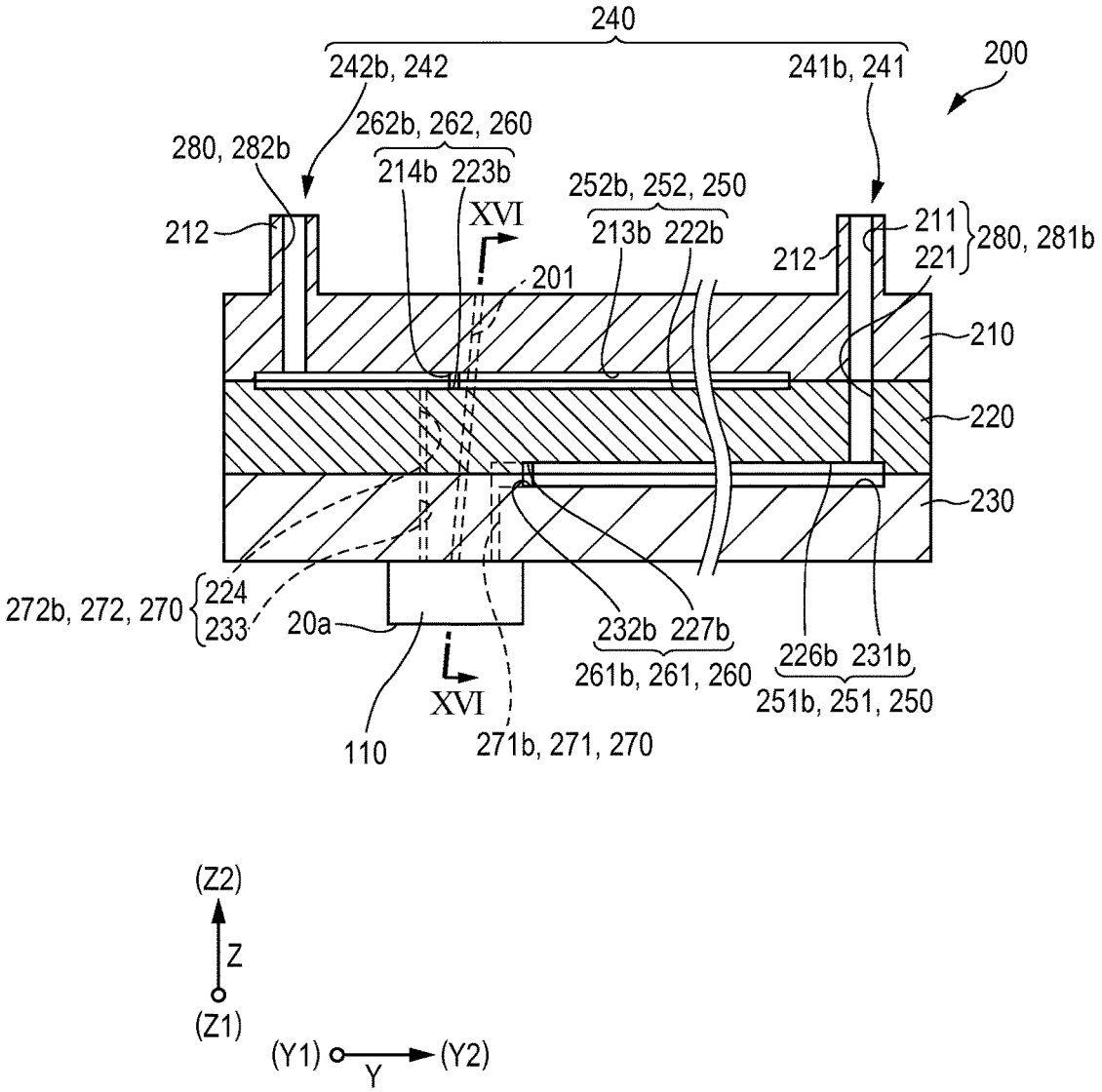
FIG. 15 is a cross-sectional view of FIGS. 10 to 13, taken along a line XV-XV.
Figure 16:
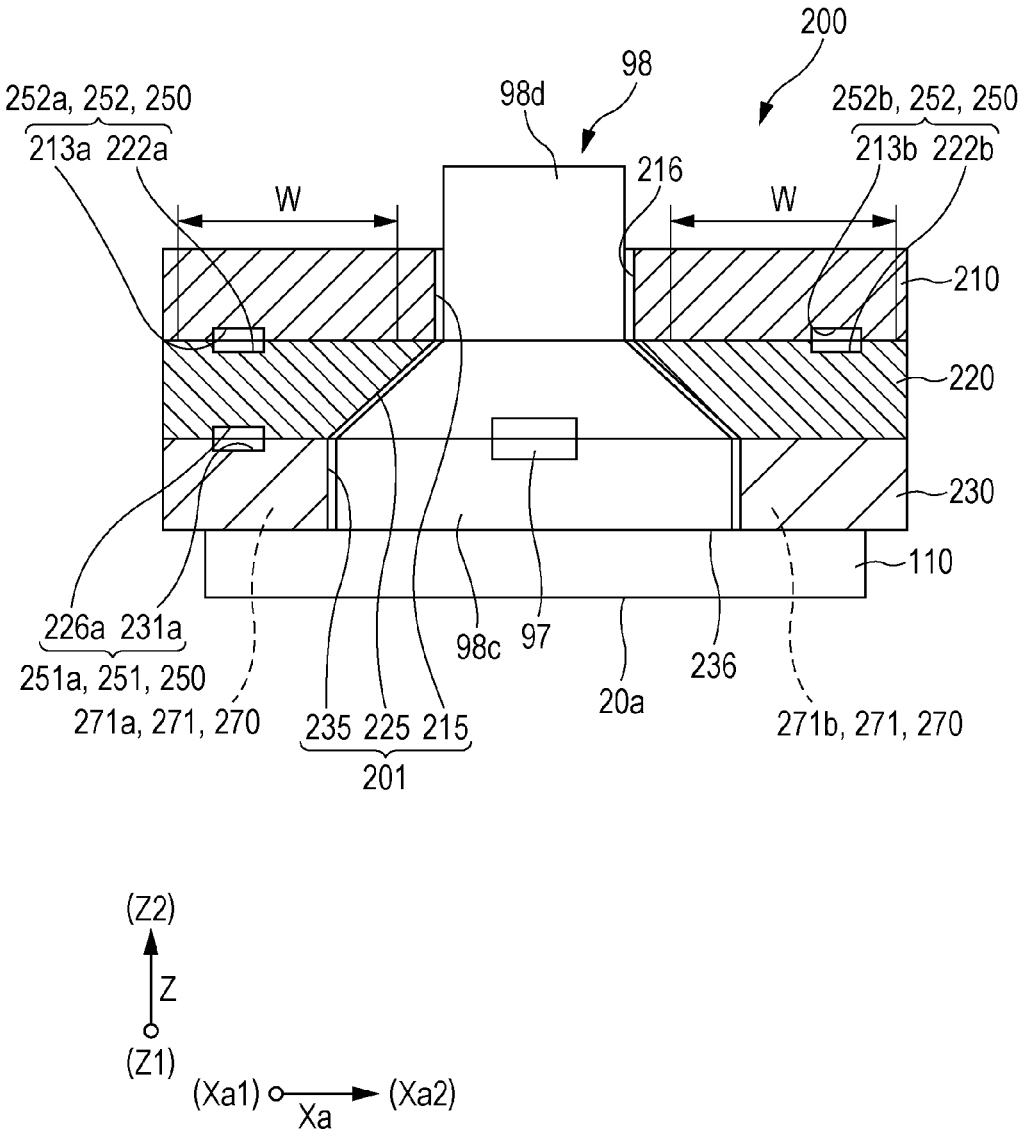
FIG. 16 is a cross-sectional view of FIGS. 10 to 15, taken along a line XVI-XVI.

Details of the flow-path member 200 according to this embodiment will be described with reference to FIGS. 10 to 16. FIG. 10 is a plan view of a first flow-path member 210 as the flow-path member 200, FIG. 11 is a plan view of a second flow-path member 220 as the flow-path member 200, and FIG. 12 is a plan view of a third flow-path member 230 as the flow-path member 200. FIG. 13 is a bottom view of the third flow-path member. FIG. 14 is a cross-sectional view of FIGS. 10 to 13, taken along a line XIV-XIV, and FIG. 15 is a cross-sectional view of FIGS. 10 to 13, taken along a line XV-XV. FIG. 16 is a cross-sectional view of FIGS. 10 to 15, taken along a line XVI-XVI. FIGS. 10 to 12 are plan views seen from the Z2 side and FIG. 13 is a bottom view seen from the Z1 side.

A flow path 240 through which ink flows is provided in the flow-path member 200. In this embodiment, the flow-path member 200 includes three flow-path members stacked in the Z direction and a plurality of flow paths 240. The three flow-path members are a first flow-path member (which corresponds to a first member of the invention) 210, a second flow-path member (which corresponds to a second member of the invention) 220, and a third flow-path member (which corresponds to a third member of the invention) 230. In the Z direction, the first flow-path member 210, the second flow-path member 220, and the third flow-path member 230 are stacked in order from the holding member 120 side (see FIG. 2) to the head main body 110 side. Although not particularly illustrated, the first flow-path member 210, the second flow-path member 220, and the third flow-path member 230 are fixed in an adhesive manner, using an adhesive. However, the configuration is not limited thereto. The first flow-path member 210, the second flow-path member 220, and the third flow-path member 230 may be fixed to each other, using a fixing unit, such as a screw. Furthermore, although the material forming the flow-path member is not particularly limited, the flow-path member can be constituted of, for example, metal, such as SUS, or resin.

In the flow path 240, one end is an introduction flow path 280 and the other end is a connection portion 290. Ink supplied from a member (which is the holding member 120, in this embodiment) upstream from the flow path 240 is introduced through the introduction flow path 280. The connection portion 290 functions as an output port through which the ink is supplied to the head. In this embodiment, four flow paths 240 are provided. In each flow path 240, ink is supplied to one introduction flow path 280. In the middle of each flow path 240, the flow path 240 branches into a plurality of flow paths. Therefore, in each flow path 240, the ink is supplied to the head main body 110 through a plurality of connection portions 290.

Some of the four flow paths 240 are first flow paths 241 and the others are second flow paths 242. In this embodiment, two first flow paths 241 and two second flow paths 242 are provided. One of the two first flow paths 241 is referred to as a first flow path 241*a* and the other is referred to as a first flow path 241*b*. Hereinafter, the first flow path 241 indicates both the first flow path 241*a* and the first flow path 241*b*. The second flow path 242 has a similar configuration to that described above.

The first flow path 241 includes a first introduction flow path 281. The first introduction flow path 281 connects a first distribution flow path 251 of the first flow path 241 and a flow path (which is the flow path of the holding member 120, in this embodiment) upstream from the flow-path member 200. The first distribution flow path 251 will be described below. In this embodiment, each of two first flow paths 241*a* and 241*b* has a first introduction flow path 281*a* and a first introduction flow path 281*b*.

Specifically, the first introduction flow path 281*a* is constituted of a through-hole 211 and a through-hole 221 which communicate with each other. The through-hole 211 is open to the top surface of a protrusion portion 212 which is provided on the Z2-side surface of the first flow-path member 210 and the through-hole 211 passes through, in the Z direction, both the first flow-path member 210 and the protrusion portion 212. The through-hole 221 passes through the second flow-path member 220 in the Z direction. The first introduction flow path 281*b* has a similar configuration to that described above. Hereinafter, the first introduction flow path 281 indicates both the first introduction flow path 281*a* and the first introduction flow path 281*b*.

The second flow path 242 includes a second introduction flow path 282. The second introduction flow path 282 connects a second distribution flow path 252 of the second flow path 242 and a flow path (which is the flow path of the holding member 120, in this embodiment) upstream from the flow-path member 200. The second distribution flow path 252 will be described below. In this embodiment, each of two first flow paths 242*a* and 242*b* has a second introduction flow path 282*a* and a second introduction flow path 282*b*.

Specifically, the second introduction flow path 282*a* is a through-hole open on the top surface of a protrusion portion 212 which is provided on the Z2-side surface of the first flow-path member 210. The second introduction flow path 282*a* passes through, in the Z direction, both the first flow-path member 210 and the protrusion portion 212. The second introduction flow path 282*b* has a similar configuration to that described above. Hereinafter, the second introduction flow path 282 indicates both the second introduction flow path 282*a* and the second introduction flow path 282*b*.

The introduction flow path 280 indicates all of the four introduction flow paths described above. The introduction flow path 280 corresponds to an inlet port of the invention.

In this embodiment, in a plan view illustrated in FIG. 10, the first introduction flow path 281*a* is disposed in the vicinity of an upper left corner of the first flow-path member 210 and the first introduction flow path 281*b* is disposed in the vicinity of a lower right corner of the first flow-path member 210. In the plan view illustrated in FIG. 10, the second introduction flow path 282*a* is disposed in the vicinity of a upper right corner of the first flow-path member 210 and the second introduction flow path 282*b* is disposed in the vicinity of a lower left corner of the first flow-path member 210.

The first flow path 241 includes the first distribution flow path 251 which is formed by both the second flow-path member 220 and the third flow-path member 230. The first distribution flow path 251 is a part of the first flow path 241, through which ink flows in a direction parallel to the liquid ejection surface 20*a*. In this embodiment, two first flow paths 241 are formed, and thus two first distribution flow paths 251 are formed. One of the two first distribution flow paths 251 is referred to as a first distribution flow path 251*a* and the other is referred to as a first distribution flow path 251*b*.

An intersection groove portion 226*a* and an intersection groove portion 231*a* are matched and sealed, in such a manner that the first distribution flow path 251*a* is formed. The intersection groove portion 226*a* is formed on the Z1-side surface of the second flow-path member 220 and extends in the Y direction. The intersection groove portion 231*a* is formed on the Z2-side surface of the third flow-path member 230 and extends in the Y direction. An intersection groove portion 226*b* and an intersection groove portion 231*b* are matched and sealed, in such a manner that the first distribution flow path 251*b* is formed. The intersection groove portion 226*b* is formed on the Z1-side surface of the second flow-path member 220 and extends in the Y direction. The intersection groove portion 231*b* is formed on the Z2-side surface of the third flow-path member 230 and extends in the Y direction.

The first distribution flow path 251*a* is constituted of both the intersection groove portions 226*a* in the second flow-path member 220 and the intersection groove portion 231*a* in the third flow-path member 230 and the first distribution flow path 251*b* is constituted of both the intersection groove portion 226*b* in the second flow-path member 220 and the intersection groove portion 231*b* in the third flow-path member 230. As a result, the cross-sectional areas of the first distribution flow paths 251*a* and 251*b* are widened, and thus pressure losses in the first distribution flow paths 251*a* and 251*b* are reduced. The first distribution flow path 251*a* may be constituted of only the intersection groove portion 226*a* in the second flow-path member 220 and the first distribution flow path 251*b* may be constituted of only the intersection groove portion 226*b* in the second flow-path member 220. Alternatively, the first distribution flow path 251*a* may be constituted of only the intersection groove portion 231*a* in the third flow-path member 230 and the first distribution flow path 251*b* may be constituted of only the intersection groove portion 231*b* in the third flow-path member 230. The intersection groove portions 226*a* and 226*b* are formed in only the second flow-path member 220 on the Z2 side, in such a manner that the degree of freedom in the arrangement of the first flow path 241 can be improved while preventing the first distribution flow paths 251*a* and 251*b* from interfering with the COF substrate 98 of which the Xa-direction width is reduced as the COF substrate 98 extends from the Z1 side to the Z2 side, as described below.

The first distribution flow path 251*a* and the first distribution flow path 251*b* are disposed in both areas located X-directionally outside the opening portion 201 (in other words, a third opening portion 235) through which the COF substrate 98 is inserted.

The second flow path 242 includes the second distribution flow path 252 which is formed by both the first flow-path member 210 and the second flow-path member 220. The second distribution flow path 252 is a part of the second flow path 242, through which ink flows in a direction parallel to the liquid ejection surface 20*a*. In this embodiment, two second flow paths 242 are formed, and thus two second distribution flow paths 252 are formed. One of the two second distribution flow paths 252 is referred to as a second distribution flow path 252*a* and the other is referred to as a second distribution flow path 252*b*.

An intersection groove portion 213*a* and an intersection groove portion 222*a* are matched and sealed, in such a manner that the second distribution flow path 252*a* is formed. The intersection groove portion 213*a* is formed on the Z1-side surface of the first flow-path member 210 and extends in the Y direction. The intersection groove portion 222*a* is formed on the Z2-side surface of the second flow-path member 220 and extends in the Y direction. An intersection groove portion 213*b* and an intersection groove portion 222*b* are matched and sealed, in such a manner that the second distribution flow path 252*b* is formed. The intersection groove portion 213*b* is formed on the Z1-side surface of the first flow-path member 210 and extends in the Y direction. The intersection groove portion 222*b* is formed on the Z2-side surface of the second flow-path member 220 and extends in the Y direction.

The second distribution flow path 252*a* is constituted of both the intersection groove portions 213*a* in the first flow-path member 210 and the intersection groove portion 222*a* in the second flow-path member 220 and the second distribution flow path 252*b* is constituted of both the intersection groove portion 213*b* in the first flow-path member 210 and the intersection groove portion 222*b* in the second flow-path member 220. As a result, the cross-sectional areas of the second distribution flow paths 252*a* and 221*b* are widened, and thus pressure losses in the second distribution flow paths 252*a* and 252*b* are reduced. The second distribution flow path 252*a* may be constituted of only the intersection groove portion 2136*a* in the first flow-path member 210 and the second distribution flow path 252*b* may be constituted of only the intersection groove portion 213*b* in the first flow-path member 210. Alternatively, the second distribution flow path 252*a* may be constituted of only the intersection groove portion 222*a* in the second flow-path member 220 and the second distribution flow path 252*b* may be constituted of only the intersection groove portion 222*b* in the second flow-path member 220. The intersection groove portions 222*a* and 222*b* are formed in only the first flow-path member 210 on the Z2 side, in such a manner that, similarly to in the case of the first distribution flow paths 251*a* and 251*b* described above, the degree of freedom in the arrangement of the second flow path 242 can be improved while preventing the second distribution flow paths 252*a* and 252*b* from interfering with the COF substrate 98.

The second distribution flow path 252*a* and the second distribution flow path 252*b* are disposed in both areas located X-directionally outside the opening portion 201 (in other words, a second opening portion 225) through which the COF substrate 98 is inserted.

Hereinafter, the first distribution flow path 251 indicates both the first distribution flow path 251*a* and the first distribution flow path 251*b*. Furthermore, the second distribution flow path 252 indicates both the second distribution flow path 252*a* and the second distribution flow path 252*b*. In addition, the distribution flow path 250 indicates all of the four distribution flow paths described above.

In the first flow path 241 of this embodiment, one introduction flow path 280 branches into a plurality of connection portions 290. In other words, the first distribution flow path 251 branches into a plurality of first bifurcation flow paths (which correspond to first flow paths of the invention) 261, in the same surface (which is a boundary surface in which the second flow-path member 220 and the third flow-path member 230 are bonded to each other) with the first distribution flow path 251.

In this embodiment, the first distribution flow path 251 branches into six first bifurcation flow paths 261, in the surface (which is a boundary surface between the second flow-path member 220 and the third flow-path member 230) parallel to the liquid ejection surface 20*a*. The six first bifurcation flow paths 261 branching off from the first distribution flow path 251*a* are referred to as first bifurcation flow paths 261*a*1 to 261*a*6. Hereinafter, the first bifurcation flow path 261*a* indicates all of the six bifurcation flow paths connected to the first bifurcation flow path 261*a*.

Similarly, six first bifurcation flow paths 261 branching off from the first distribution flow path 251*b* are referred to as first bifurcation flow paths 261*b*1 to 261*b*6. Hereinafter, the first bifurcation flow path 261*b* indicates all of the six bifurcation flow paths connected to the first bifurcation flow path 261*b*. In addition, the first bifurcation flow path 261 indicates all of the twelve bifurcation flow paths connected to the first bifurcation flow paths 261*a* and 261*b*.

Reference letters and numerals corresponding to the first bifurcation flow paths 261*a*2 to 261*a*5 of the six first bifurcation flow paths 261*a*1 to 261*a*6 aligned in the Y direction are omitted in the accompanying drawings. However, it is assumed that the first bifurcation flow paths 261*a*2 to 261*a*5 are aligned in order from the Y1 side to the Y2 side. The first bifurcation flow paths 261*b*1 to 261*b*6 have a similar configuration to that described above.

Specifically, a plurality of branch groove portions 232*a* which communicate with the intersection groove portion 231*a* and extend to the opening portion 201 side are provided in the Z2-side surface of the third flow-path member 230. A plurality of branch groove portions 227*a* which communicate with the intersection groove portion 226*a* and extend to the opening portion 201 side are provided in the Z1-side surface of the second flow-path member 220. The branch groove portion 227*a* and the branch groove portion 232*a* are sealed in a state where the branch groove portion 227*a* and the branch groove portion 232*a* face each other, in such a manner that the first bifurcation flow path 261*a* is formed.

A plurality of branch groove portions 232*b* which communicate with the intersection groove portion 231*b* and extend to the opening portion 201 side are provided in the Z2-side surface of the third flow-path member 230. A plurality of branch groove portions 227*b* which communicate with the intersection groove portion 226*b* and extend to the opening portion 201 side are provided in the Z1-side surface of the second flow-path member 220. The branch groove portion 227*b* and the branch groove portion 232*b* are sealed in a state where the branch groove portion 227*b* and the branch groove portion 232*b* face each other, in such a manner that the first bifurcation flow path 261*b* is formed.

The first bifurcation flow path 261*a* is constituted of both the branch groove portions 227*a* in the second flow-path member 220 and the branch groove portion 232*a* in the third flow-path member 230 and the first bifurcation flow path

261*b* is constituted of both the branch groove portion 227*b* in the second flow-path member 220 and the branch groove portion 232*b* in the third flow-path member 230. As a result, the cross-sectional areas of the first bifurcation flow paths 261*a* and 261*b* are widened, and thus pressure losses in the first bifurcation flow paths 261*a* and 261*b* are reduced. The first bifurcation flow path 261*a* may be constituted of only the branch groove portion 227*a* in the second flow-path member 220 and the first bifurcation flow path 261*b* may be constituted of only the branch groove portion 227*b* in the second flow-path member 220. Alternatively, the first bifurcation flow path 261*a* may be constituted of only the branch groove portion 232*a* in the third flow-path member 230 and the first bifurcation flow path 261*b* may be constituted of only the branch groove portion 232*b* in the third flow-path member 230. For example, the branch groove portions 227*a* and 227*b* are formed in only the second flow-path member 220 on the Z2 side. As a result, in an area Q which is inclined in the Ya direction, and thus the Ya-direction width increases as the area Q extends from the Z1 side to the Z2 side, as described below, the degree of freedom in the arrangement of the first flow path 241 can be improved while preventing interference with the COF substrate 98. Furthermore, the branch groove portions 232*a* and 232*b* are formed in only the third flow-path member 230 on the Z1 side. As a result, in an area P of which the width in the Ya direction increases as the area P extends from the Z2 side to the Z1 side, the degree of freedom in the arrangement of the first flow path 241 can be improved while preventing interference with the COF substrate 98.

In the second flow path 242, one introduction flow path 280 branches into a plurality of connection portions 290. The second distribution flow path 252 branches into a plurality of second bifurcation flow paths (which correspond to the first flow paths of the invention) 262, in the same surface (which is a boundary surface in which the first flow-path member 210 and the second flow-path member 220 are bonded to each other) with the second distribution flow path 252. Details of this will be described below.

In this embodiment, the second distribution flow path 252 branches into six second bifurcation flow paths 262, in the surface (which is a boundary surface between the first flow-path member 210 and the second flow-path member 220) parallel to the liquid ejection surface 20*a*. The six second bifurcation flow paths 262 branching off from the second distribution flow path 252*a* are referred to as second bifurcation flow paths 262*a*1 to 262*a*6.

Similarly, six second bifurcation flow paths 262 branching off from the second distribution flow path 252*b* are referred to as second bifurcation flow paths 262*b*1 to 262*b*6.

Hereinafter, the second bifurcation flow path 262*a* indicates all of the six bifurcation flow paths connected to the second bifurcation flow path 262*a*. The second bifurcation flow path 262*b* indicates all of the six bifurcation flow paths connected to the second bifurcation flow path 262*b*. The second bifurcation flow path 262 indicates all of the twelve bifurcation flow path connected to the second bifurcation flow paths 262*a* and 262*b*. Furthermore, the bifurcation flow path 260 indicates all of the twenty-four bifurcation flow paths described above.

Reference letters and numerals corresponding to second bifurcation flow paths 262*a*2 to 262*a*5 of the six second bifurcation flow paths 262*a*1 to 262*a*6 aligned in the Y direction are omitted in the accompanying drawings. However, it is assumed that the second bifurcation flow paths 262*a*2 to 262*a*5 are aligned in order from the Y1 side to the Y2 side. The second bifurcation flow paths 262*b*1 to 262*b*6 have a similar configuration to that described above.

Specifically, a plurality of branch groove portions 223*a* which communicate with the intersection groove portions 222*a* and extend to the opening portion 201 side are provided in the Z2-side surface of the second flow-path member 220. In addition, a plurality of branch groove portions 214*a* which communicate with the intersection groove portions 213*a* and extend to a side opposite to the opening portion 201 side are provided in the Z1-side surface of the first flow-path member 210. The branch groove portion 223*a* and the branch groove portion 214*a* are sealed in a state where the branch groove portion 223*a* and the branch groove portion 214*a* face each other, in such a manner that the second bifurcation flow path 262*a* is formed.

A plurality of branch groove portions 223*b* which communicate with the intersection groove portions 222*b* and extend to the opening portion 201 side are provided in the Z2-side surface of the second flow-path member 220. In addition, a plurality of branch groove portions 214*b* which communicate with the intersection groove portions 213*b* and extend to the opening portion 201 side are provided in the Z1-side surface of the first flow-path member 210. The branch groove portion 223*b* and the branch groove portion 214*b* are sealed in a state where the branch groove portion 223*b* and the branch groove portion 214*b* face to each other, in such a manner that the second bifurcation flow path 262*b* is formed.

The second bifurcation flow path 262*a* is constituted of both the branch groove portions 214*a* in the first flow-path member 210 and the branch groove portion 223*a* in the second flow-path member 220 and the second bifurcation flow path 262*b* is constituted of both the branch groove portion 214*b* in the first flow-path member 210 and the branch groove portion 223*b* in the second flow-path member 220. As a result, the cross-sectional areas of the second bifurcation flow paths 262*a* and 262*b* are widened, and thus pressure losses in the second bifurcation flow paths 262*a* and 262*b* are reduced. The second bifurcation flow path 262*a* may be constituted of only the branch groove portion 214*a* in the first flow-path member 210 and the second bifurcation flow path 262*b* may be constituted of only the branch groove portion 214*b* in the first flow-path member 210. Alternatively, the second bifurcation flow path 262*a* may be constituted of only the branch groove portion 223*a* in the second flow-path member 220 and the second bifurcation flow path 262*b* may be constituted of only the branch groove portion 223*b* in the second flow-path member 220. The branch groove portions 214*a* and 214*b* are formed in only the first flow-path member 210 on the Z2 side. Accordingly, in the area Q which is inclined in the Ya direction, and thus the Ya-direction width increases as the area Q extends from the Z1 side to the Z2 side, as described below, the degree of freedom in the arrangement of the second flow path 242 can be improved while preventing interference with the COF substrate 98. Furthermore, the branch groove portions 223*a* and 223*b* are formed in only the second flow-path member 220 on the Z1 side. As a result, in the area P of which the width in the Ya direction increases as the area P extends from the Z2 side to the Z1 side, the degree of freedom in the arrangement of the second flow path 242 can be improved while preventing interference with the COF substrate 98.

An end portion of the first bifurcation flow path 261, which is the end portion on a side opposite to the first distribution flow path 251, is connected to a first vertical flow path (which corresponds to a second flow path of the invention) 271. Specifically, the first vertical flow path 271 is formed as a through-hole which passes through the third flow-path member 230 in the Z direction.

In this embodiment, vertical flow paths are respectively connected to the first bifurcation flow paths 261*a*1 to 261*a*6 and 261*b*1 to 261*b*6. In other words, in total, twelve first vertical flow paths 271*a*1 to 271*a*6 and 271*b*1 to 271*b*6 are respectively connected to the first bifurcation flow paths.

Similarly, an end portion of the second bifurcation flow path 262, which is the end portion on a side opposite to the second distribution flow path 252, is connected to a second vertical flow path (which is the second flow path of the invention) 272. Specifically, a through-hole 224 is provided in the second flow-path member 220, in a state where the through-hole 224 passes through the second flow-path member 220 in the Z direction. A through-hole 233 is provided in the third flow-path member 230, in a state where the through-hole 233 passes through the third flow-path member 230 in the Z direction. The through-hole 224 and the through-hole 233 communicate with each other, in such a manner that the second vertical flow path 272 is formed.

In this embodiment, in total, twelve second vertical flow paths 272*a*1 to 272*a*6 and 272*b*1 to 272*b*6 are respectively connected to second bifurcation flow paths 262*a*1 to 262*a*6 and 262*b*1 to 262*b*6.

Hereinafter, a first vertical flow path 271*a* indicates the first vertical flow paths 271*a*1 to 271*a*6. A first vertical flow path 271*b* indicates the first vertical flow paths 271*b*1 to 271*b*6. The first vertical flow path 271 indicates all of the first vertical flow paths 271*a* and the first vertical flow paths 271*b*.

Similarly, a second vertical flow path 272*a* indicates the second vertical flow paths 272*a*1 to 272*a*6. A second vertical flow path 272*b* indicates the second vertical flow paths 272*b*1 to 272*b*6. The second vertical flow path 272 indicates all of the second vertical flow paths 272*a* and the second vertical flow paths 272*b*.

Furthermore, a vertical flow path 270 indicates all of the twenty-four vertical flow paths described above.

Reference letters and numerals corresponding to the first vertical flow paths 271*a*2 to 271*a*5 of the six first vertical flow paths 271*a*1 to 271*a*6 aligned in the Y direction are omitted in the accompanying drawings. However, it is assumed that the first vertical flow paths 271*a*2 to 271*a*5 are aligned in order from the Y1 side to the Y2 side. The first vertical flow paths 271*b*1 to 271*b*6, the second vertical flow paths 272*a*1 to 272*a*6, and the second vertical flow paths 272*b*1 to 272*b*6 have a similar configuration to that described above.

The vertical flow path 270 described above has the connection portion 290 which is an opening on the Z1 side of the third flow-path member 230. The connection portion 290 communicates with the introduction path 44 provided in the head main body 110. Details of this will be described below.

In this embodiment, the first vertical flow paths 271*a*1 to 271*a*6 respectively have first connection portions 291*a*1 to 291*a*6 which are openings on the Z1 side of the third flow-path member 230. In addition, the first vertical flow paths 271*b*1 to 271*b*6 respectively have first connection portions 291*b*1 to 291*b*6 which are openings on the Z1 side of the third flow-path member 230. Similarly, the second vertical flow paths 272*a*1 to 272*a*6 respectively have second connection portions 292*a*1 to 291*a*6 which are openings on the Z1 side of the third flow-path member 230. In addition, the second vertical flow paths 272*b*1 to 272*b*6 respectively have second connection portions 292*b*1 to 291*b*6 which are openings on the Z1 side of the third flow-path member 230.

The first connection portion 291*a*1, the first connection portion 291*b*1, the second connection portion 292*a*1, and the second connection portion 292*b*1 are connected to one of the six head main bodies 110. The first connection portions 291*a*2 to 291*a*6, the first connection portions 291*b*2 to 291*b*6, the second connection portions 292*a*2 to 292*a*6, and the second connection portions 292*b*2 to 292*b*6 have a similar configuration to that described above. In other words, the first flow path 241*a*, the first flow path 241*b*, the second flow path 242*a*, and the second flow path 242*b* are connected to one head main body 110.

Hereinafter, the first connection portion 291*a* indicates the first connection portions 291*a*1 to 291*a*6. The first connection portion 291*b* indicates the first connection portions 291*b*1 to 291*b*6. A first connection portion 291 indicates all of the first connection portions 291*a* and the first connection portions 291*b*.

Similarly, the second connection portion 292*a* indicates the second connection portions 292*a*1 to 292*a*6. The second connection portion 292*b* indicates the second connection portion 292*b*1 to 292*b*6. A second connection portion 292 indicates all of the second connection portions 292*a* and the second connection portions 292*b*.

Furthermore, a connection portion 290 indicates all of the twenty-four connection portions described above.

The flow-path member 200 according to this embodiment includes four flow paths 240, in other words, the first flow path 241*a*, the first flow path 241*b*, a second flow path 242*a*, and a second flow path 242*b*, as described above. In each flow path 240, a part extending from the introduction flow path 280 as an ink inlet port to an distribution flow path 250 constitutes one flow path and the distribution flow path 250 branches into bifurcation flow paths 260. The bifurcation flow paths 260 are connected to a plurality of head main bodies 110 via both the vertical flow paths 270 and the connection portions 290.

In this embodiment, a black ink Bk, a magenta ink M, a cyan ink C, and a yellow ink Y are used. The cyan ink C, the yellow ink Y, the black ink Bk, and the magenta ink M are respectively supplied from the liquid storage units (not illustrated) to the first flow path 241*a*, the first flow path 241*b*, the second flow path 242*a*, and the second flow path 242*b*. The color inks respectively flow through the first flow path 241*a*, the first flow path 241*b*, the second flow path 242*a*, and the second flow path 242*b*, and then the color inks are supplied to the head main bodies 110.

Figure 17:
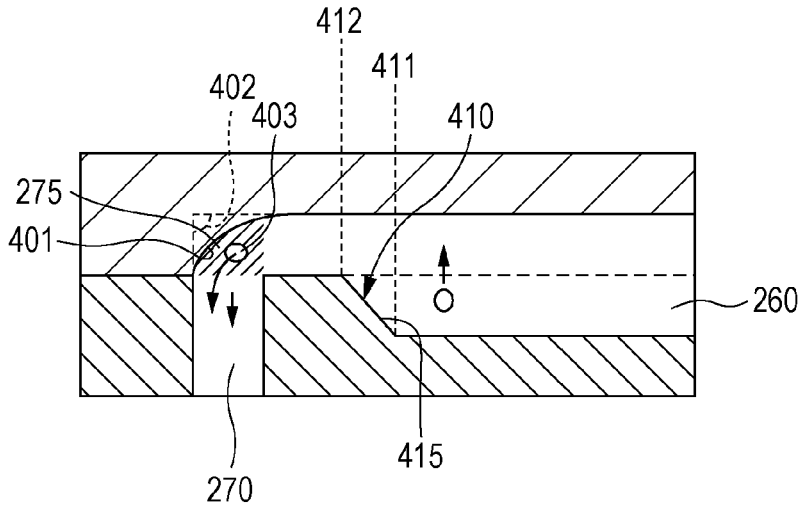
FIG. 17 illustrates a schematic cross-sectional view of a bifurcation flow path and a vertical flow path.

Here, details of a connection portion between the bifurcation flow path 260 and the vertical flow path 270 will be described with reference to FIG. 17.

The bifurcation flow path 260 extends in a direction intersecting the vertical flow path 270 which extends in the vertical direction, as described above. In other words, the bifurcation flow path 260 of this embodiment extends in a direction perpendicular to the vertical direction. In a case where a portion in which the extended flow path of the bifurcation flow path 260 intersects the extended flow path of the vertical flow path 270 is set to the connection portion 275, when the shape of a surface of the connection portion 275, which is the surface on the upper side in the vertical direction, is formed as follows, in a plan view of a cross-sectional area including both the extension direction of the bifurcation flow path 260 and the extension direction of the vertical flow path 270. A connection surface 401 connecting the surface of the bifurcation flow path 260 and the surface of the vertical flow path 270 is curved. The reason for this is that it is easy for air bubbles 403 to flow along the connection surface 401 on the upper side of the connection portion 275 in the vertical direction, and thus the air bubbles 403 is prevented from remaining in the upper side of the connection portion 275 in the vertical direction. Furthermore, the shape of the upper-side surface of the connection portion 275 in the vertical direction is not limited to a curved shape. The upper-side surface of the connection portion 275 may be constituted of, for example, an inclined surface or a plurality of connected inclined surfaces (in other words, the upper-side surface may be formed in a polygonal shape), as long as it can prevent the air bubbles 403 from remaining. The upper-side surface of the connection portion 275 may be constituted of a surface which intersects both the surface of the bifurcation flow path 260 and the surface of the vertical flow path 270, at an angle greater than an angle 402 between an imaginary line extending in the extension direction of the bifurcation flow path 260 and an imaginary line extending in the extension direction of the vertical flow path 270.

In the bifurcation flow path 260, the intersection portion 410 is provided in the vicinity of the vertical flow path 270. The intersection portion 410 is an area which extends from a start position 411 to an end position 412, in the flowing direction of ink in the bifurcation flow path 260. The intersection portion 410 of this embodiment includes an intersection surface 415 constituted of an inclined surface. Such an intersection surface 415 is provided in the intersection portion 410, in such a manner that the cross-sectional area of the flow path is gradually reduced as the flow path extends to the downstream side, toward the connection portion 275. Therefore, the flow velocity gradually increases, and thus flowing of air bubbles in the connection portion 275 is promoted. As a result, it is possible to prevent the air bubbles 403 from remaining.

When the intersection portion 410 is provided in the first bifurcation flow path portion 261, the Z-direction depth of the branch groove portions 232*a* and 232*b* in the Z2-side surface of the third flow-path member 230 may be gradually reduced as the branch groove portions extend from a side in which the branch groove portions 232*a* and 232*b* respectively communicate with the distribution groove portions 231*a* and 231*b* to a side in which the openings of the through-hole portions of the first vertical flow paths 271 are provided. Specifically, on a side in which the branch groove portions 232*a* and 232*b* respectively communicate with the distribution groove portions 231*a* and 231*b*, the Z-direction depth of the branch groove portions 232*a* and the 232*b* on the Z2-side surface of the third flow-path member 230 may be set to the same value as that of the distribution groove portions 231*a* and 231*b*. On a side in which the openings of the through-hole portions of the first vertical flow paths 271 are provided, the depth of the branch groove portions 232*a* and 232*b* may be set to the value smaller than that of the distribution groove portions 231*a* and 231*b*. When the intersection portion 410 is provided in the second bifurcation flow path 262, a similar configuration to that described above may be applied to second flow-path member 220, instead of the third flow-path member 230. The intersection portion 410 is provided on, particularly, a lower side in the vertical direction, in such a manner that flowing of ink to the connection surface 401 is promoted on the upper side of the connection portion 275 in the vertical direction. Accordingly, the air bubbles 403 flow to the vertical flow path 270, along the connection surface 401 of the connection portion 275, which is located on the upper side in the vertical direction. As a result, it is possible to prevent the air bubbles 403 from remaining.

Furthermore, it is preferable that the cross-sectional area of the vertical flow path 270 is smaller than that of the bifurcation flow path 260. In this case, the flow velocity of ink the vertical flow path 270 increases, and thus it is possible to effectively flow the air bubbles 403 to the lower side in the vertical direction. In addition, it is preferable that the cross-sectional area of the vertical flow path 270 is smaller than the cross-sectional area of a part of the bifurcation flow path 260, which is the portion extending from the intersection portion 410 to the connection portion 275. In this case, the flow velocity of ink the vertical flow path 270 increases, and thus it is possible to effectively flow the air bubbles 403 to the lower side in the vertical direction.

For example, the inclination angle or the length of the inclined surface of the intersection surface 415 is appropriately set, in such a manner that it is possible to increase the flow velocity and, further, it is possible to adjust the degree of reduction in pressure loss and discharge properties of the air bubbles 403.

Figure 18:
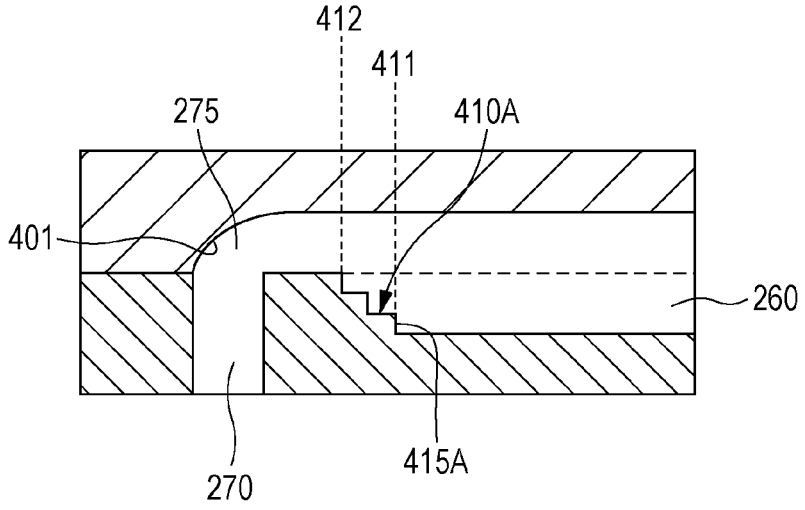
FIG. 18 is a cross-sectional view illustrating a modification example of an intersection portion.

The configuration of the intersection surface 415 is not limited to the configuration in which the intersection surface 415 is constituted of an inclined surface. The intersection surface 415 may be an intersection surface 415A which is constituted of a stepped surface, as illustrated in FIG. 18.

Furthermore, any configuration can be applied to the intersection portion 410, as long as it can change the cross-sectional area of the flow-path. Thus, the cross-sectional area of the intersection portion 410 may change by changing the width (which is the size of the flow path in a direction perpendicular to the paper of FIG. 17) of the flow path.

In other words, it is preferable that the intersection portion 410 (in other words, the intersection surface 415) is provided on the lower side of the bifurcation flow path 260 in the vertical direction. However, the intersection surface 415 may be provided on the upper side or a side surface of the bifurcation flow path 260. However, when the intersection surface 415 is provided on the lower side of the bifurcation flow path 260, as in the case of this embodiment, the flow passing through the intersection portion 410 is directed to the connection surface 401. Thus, even when the air bubbles 403 are located in the vicinity of the connection surface 401, the air bubbles 403 can be reliably discharged by the flow passing the intersection portion 410. Furthermore, it is not necessary to increase/decrease the width of the flow path in a direction perpendicular to the paper of FIG. 17, in order to increase/decrease the cross-sectional area. Thus, when a plurality of flow paths are aligned in the direction perpendicular to the paper of FIG. 17, there is an advantage in that a gap between adjacent flow paths can be reduced. In other words, in the first bifurcation flow path portions 261*a*1 to 261*a*6, a Y-direction gap between adjacent flow paths can be reduced. Similarly, a Y-direction gap between adjacent flow paths of the other bifurcation flow paths 260 can be reduced.

Furthermore, since such an intersection portion 410 is provided, it is possible to reduce the pressure loss in the flow path extending to the intersection portion 410, as small as possible. As a result, it is possible to reduce the entirety of pressure losses. In other words, In the distribution flow path 250 and the bifurcation flow path 260, the pressure losses in the flow paths extending to the intersection portions 410 are reduced as small as possible and the air-bubble discharge properties in the connection portions 275 are improved by increasing the flow velocity in the intersection portions 410. As a result, both a reduction in pressure loss and favorable air-bubble discharge properties are obtained in the entirety of the flow paths.

Figure 19:
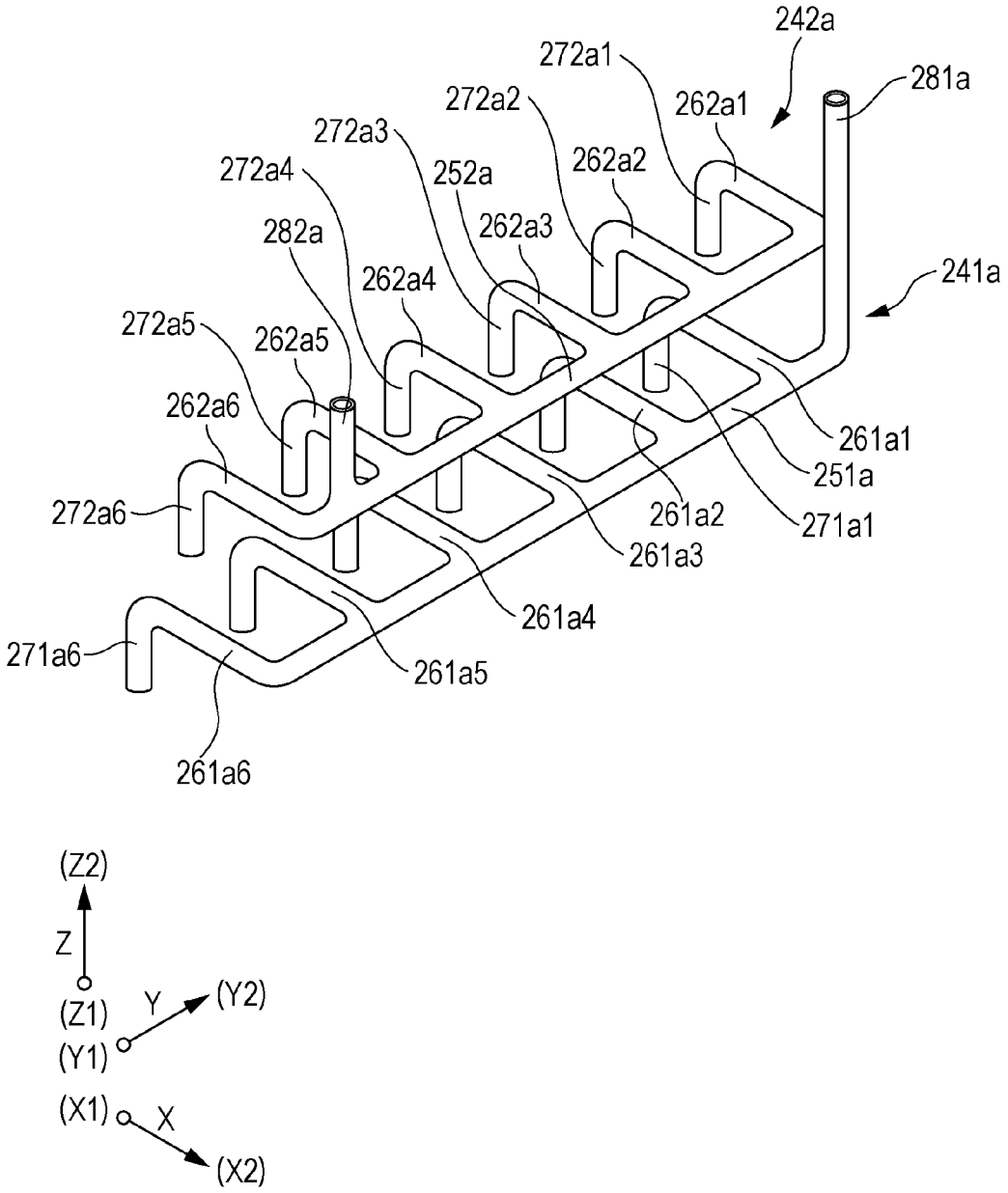
FIG. 19 is a schematic perspective view illustrates the bifurcation flow path, the vertical flow path, and a distribution flow path.

In this embodiment, six groups of the bifurcation flow paths 260 and the vertical flow paths 270 are provided in one flow path 240, as described above. The distances from the introduction flow path 280 to the vertical flow paths 270 of the respective groups are different from each other. FIG. 19 illustrates a schematic perspective view of both the first flow path 241*a* and the second flow path 242*a* of the flow path 240.

The respective groups of the first bifurcation flow path portions 261*a*1 to 261*a*6 and the first vertical flow paths 271*a*1 to 271*a*6 communicate with the first distribution flow path 251*a* communicating with the first introduction flow path 281*a*, as illustrated in FIG. 19. Furthermore, the distances from the first introduction flow path 281*a* to the respective first vertical flow paths 271*a*1 to 271*a*6 of the groups are different from each other. Furthermore, the respective groups of the second bifurcation flow paths 262*a*1 to 262*a*6 and the second vertical flow paths 272*a*1 to 272*a*6 communicate with the second distribution flow path 252*a* communicating with the second introduction flow path 282*a*. In addition, the distances from the second introduction flow path 282*a* to the respective second vertical flow paths 272*a*1 to 272*a*6 of the groups are different from each other.

In the bifurcation flow paths 260 having a configuration in which the distances from the introduction flow path 280 to the respective vertical flow paths 270 of the groups are different from each other, variation in pressure losses occur in portions extending to the intersection portions 410. However, the degree of intersection between the intersection surface 415 and the start position 411 and/or the end position 412 of the intersection portion 410 changes, in such a manner that the air-bubble discharge properties and the degree of reduction in the pressure loss in the intersection portion 410 can change. As a result, it is possible to reduce variation in the pressure losses in the bifurcation flow paths 260.

Figure 20A:
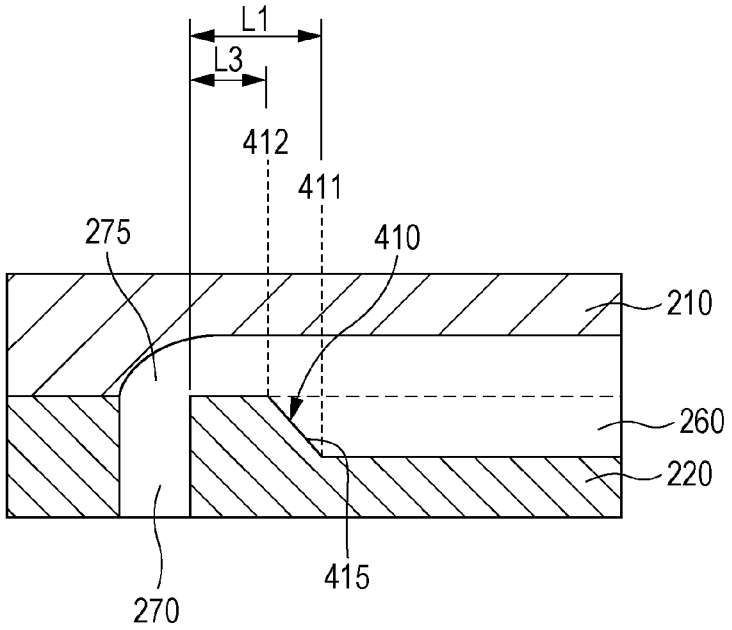
FIGS. 20A and 20B are schematic cross-sectional views illustrating the bifurcation flow path and the vertical flow path.
Figure 20B:
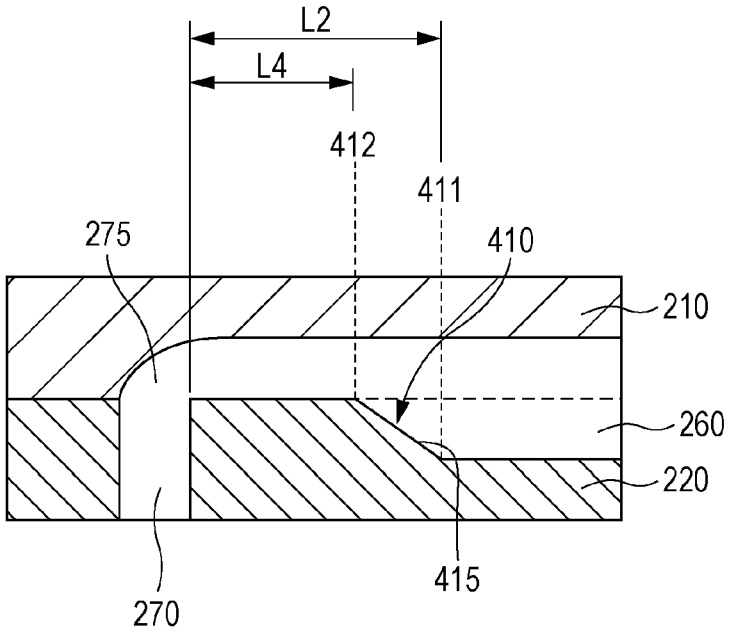

FIGS. 20A and 20B schematically illustrate such an example.

In a plurality of bifurcation flow paths 260 having a configuration in which, for example, the distances from the introduction flow path 280 to the respective vertical flow paths 270 are different from each other, the amount of the pressure loss in the distant bifurcation flow path 260 is greater than that of the close bifurcation flow path 260, as illustrated in FIGS. 20A and 20B. In this case, to reduce variation in the pressure losses in the bifurcation flow paths 260, the intersection portions 410 may be provided in the distant bifurcation flow path 260 and the close bifurcation flow path 260, in a state where a distant L1 (see FIG. 20A) from the start position 411 of the intersection portion 410 of the distant bifurcation flow path 260 to the vertical flow path 270 is set to be smaller than a distant L2 (see FIG. 20B) from the start position 411 of the intersection portion 410 of the close bifurcation flow path 260 to the vertical flow path 270. In other words, the intersection portions 410 are provided in the bifurcation flow paths 260, in a state where the relationship of L1<L2 is satisfied.

Alternatively, the intersection portions 410 may be provided in the distant bifurcation flow path 260 and the close bifurcation flow path 260, in a state where a distant L3 (see FIG. 20A) from the end position 412 of the intersection portion 410 of the distant bifurcation flow path 260 to the vertical flow path 270 is set to be smaller than a distant L4 (see FIG. 20B) from the end position 412 of the intersection portion 410 of the close bifurcation flow path 260 to the vertical flow path 270. In other words, the intersection portions 410 are provided in the bifurcation flow paths 260, in a state where the relationship of L3<L4 is satisfied.

Meanwhile, when it is assumed that the flow rates in the respective vertical flow paths 270 are set to the same value, as illustrated in FIG. 19, the flow rate and the flow velocity in the distribution flow path 250 change in accordance with the number of bifurcation portions. Accordingly, the cross-sectional area of the distribution flow path 250 is gradually reduced in accordance with the number of bifurcation points, in such a manner that variation in the flow velocities in the bifurcation flow paths 260 of the respective groups, which are connected to the distribution flow path 250, can be reduced.

In other words, the cross-sectional areas of the respective bifurcation flow paths are gradually reduced, in such a manner that the variation in flow velocities can be reduced. Specifically, the cross-sectional area of a part of the distribution flow path, which is the portion from the introduction flow path 280 to a first bifurcation flow path is set to the maximum value and the cross-sectional area of a part of the of the distribution flow path, which is the portion to a next bifurcation flow path is set to a value smaller than the maximum value.

Figure 21:
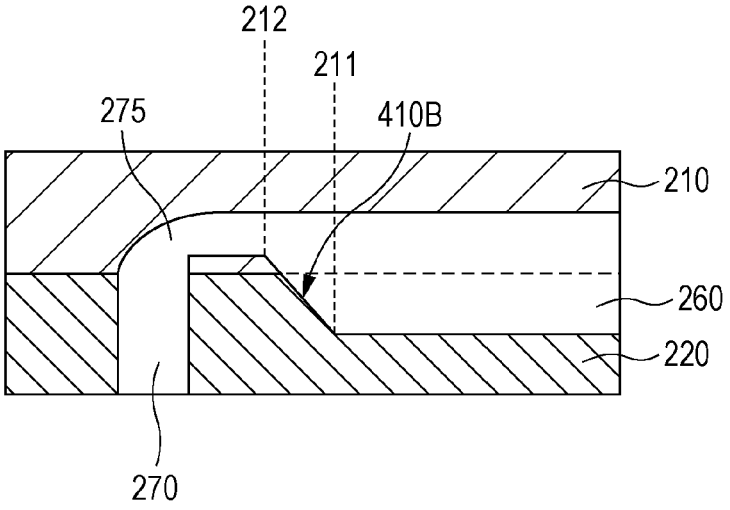
FIG. 21 is a cross-sectional view illustrating a modification example of the intersection portion.

The second bifurcation flow path 262 is formed in the boundary surface between the first flow-path member 210 and the second flow-path member 220, as illustrated in FIGS. 20A and 20B. However, it is preferable that the end position 412 of the intersection portion 410 is formed by only the second flow-path member 220, without using the first flow-path member 210 and other members. In other words, when an intersection portion 410B of which the end position 412 is located on the side of the first flow-path member 210 is provided, as illustrated in FIG. 21, the intersection portion 410B cannot be formed by only the branch groove portions 223*a*, 223*b*, 232*a*, and 232*b* in the first flow-path member 210. Thus, it is necessary to provide a through-hole which passes through the first flow-path member 210, in a direction perpendicular to the Z direction. As a result, it is difficult to perform processing. Although not illustrated, a configuration in which an intersection portion is formed by the first flow-path member 210 and other members is unpreferable in terms of processing. The reason for this is an increase in the number of parts. This situation is shared by the first bifurcation flow path portion 261 which is formed in the boundary surface between the second flow-path member 220 and the third flow-path member 230.

Figure 22:
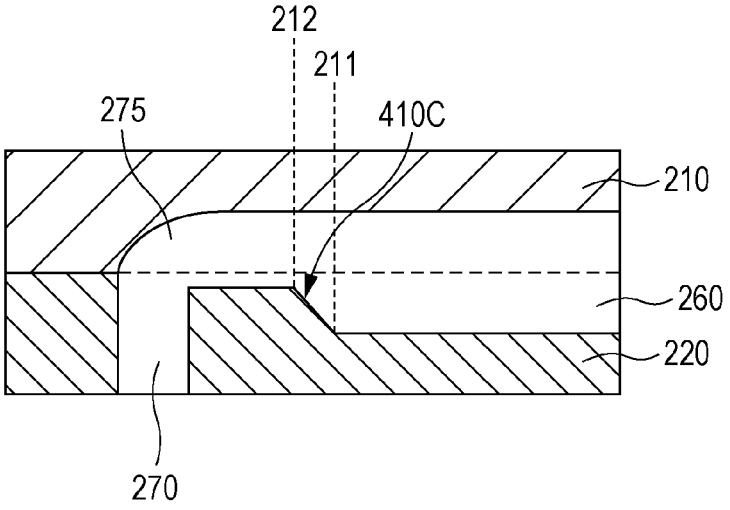
FIG. 22 is a cross-sectional view illustrating a modification example of the intersection portion.

It is more preferable that an intersection portion 410C of the second bifurcation flow path 262 is formed by only the first flow-path member 210, as illustrated in FIG. 22, and the end position 412 of the intersection portion 410C is located further on the side of the second flow-path member 220 than the boundary surface between the first flow-path member 210 and the second flow-path member 220. In other words, a part of the intersection portion, which is a portion deciding the cross-sectional area of the flow path, may be located further on the side of the second flow-path member 220 than the boundary surface between the first flow-path member 210 and the second flow-path member 220. When the end position 412 is located in the boundary surface between the first flow-path member 210 and the second flow-path member 220, it is difficult to manage an adhesion surface (in other words, it is difficult to manage surface roughness and a reference surface). When the configuration described above is not applied to the invention, the following problem is caused. When an adhesion surface is processed with relatively higher precision, compared to a flow path surface, the adhesion surface and the flow path surface are located, in the same plane, close to each other. As a result, management of both surfaces is complicated, and thus there is a problem in that it is difficult to perform processing. Accordingly, it is preferable that the intersection portion 410C of the second bifurcation flow path 262 is formed by only the first flow-path member 210, as illustrated in FIG. 22. This situation is shared by the first bifurcation flow path portion 261 which is formed in the boundary surface between the second flow-path member 220 and the third flow-path member 230.

In this case, the bifurcation flow path 260 is formed in both a portion between the first flow-path member 210 and the second flow-path member 220 and a portion between the second flow-path member 220 and the third flow-path member 230, and thus the bifurcation flow path 260 is formed in a two-stage shape, as described above. Similarly, the distribution flow path 250 is formed in a two-stage shape.

Figure 23A:
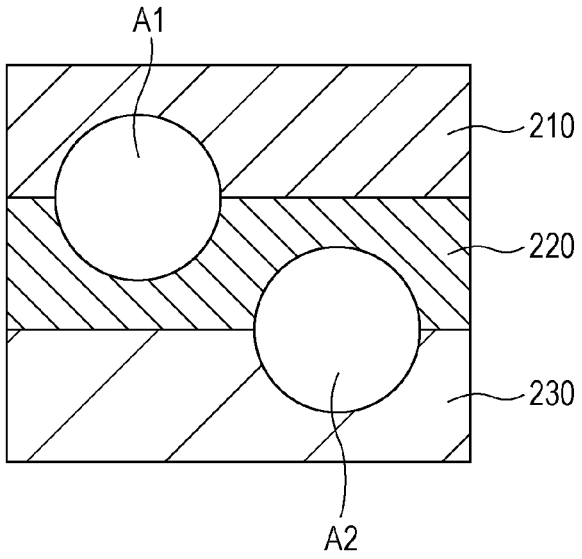
FIGS. 23A and 23B are schematic cross-sectional views illustrating the configuration of the flow path.
Figure 23B:
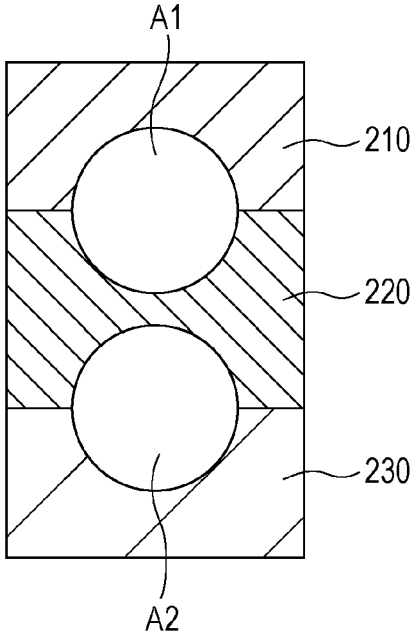

FIGS. 23A and 23B illustrate the schematic configuration of the distribution flow path 250 and the bifurcation flow path 260. In a case where a flow path A1 of a first stage and a flow path A2 of a second stage are projected in the vertical direction, when the projection images thereof do not overlap, as illustrated in FIG. 23A, it is possible to reduce the vertical-direction (in other words, the thickness-direction) size of the member. When the projection images overlap each other, as illustrated in FIG. 23B, it is possible to reduce the X-direction/Y-direction (which is the width direction of the flow path) size of the member. Either configuration may be applied to the invention. Both the flow path A1 of the first stage and the flow path A2 of the second stage may be the distribution flow paths 250 or may be the bifurcation flow paths 260.

In the four flow paths 240 described above, in the flow paths A1 of the first stage and the flow paths A2 of the second stage, the distances from the inlet ports of the introduction flow paths 280 to the distribution flow paths 250 are different from each other. Thus, variation in the pressure losses occurs in the flow paths. Accordingly, it is preferable that, in a portion between the flow path A1 of the first stage and the flow path A2 of the second stage, the diameter of the introduction flow path 280 and the cross-sectional area of a part of the distribution flow path 250, which is the portion extending to the intersection portion 410, change, in order to reduce the variation in the pressure losses. Specifically, the cross-sectional area of a part of the first flow path 241, which is the portion extending to the intersection portion 410 of the first flow path portion 251 may be set to be greater than the cross-sectional area of a part of the second flow path 242, which is the portion extending to the intersection portion 410 of the second distribution flow path 252. Furthermore, it is preferable that, to allow air bubbles to flow downward, the size of the introduction flow path 280 is reduced as much as possible. The cross-sectional area of the flow path is slightly increased as the length of the introduction flow path 280 increases, in such a manner that variation in the pressure loss can be reduced.

In this case, the opening portion 201 is provided in the flow-path member 200. The COF substrate 98 provided in the head main body 110 is inserted through the opening portion 201. In this embodiment, the first opening portion 215 is provided in the first flow-path member 210. The first opening portion 215 is inclined with respect to the Z direction and passes through the first flow-path member 210. The second opening portion 225 is provided in the second flow-path member 220, the second opening portion 225 is inclined with respect to the Z direction and passes through the second flow-path member 220. The third opening portion 235 is provided in the third flow-path member 230. The third opening portion 235 is inclined with respect to the Z direction and passes through the third flow-path member 230.

The first opening portion 215, the second opening portion 225, and the third opening portion 235 communicate with one another, in such a manner that one opening portion 201 is formed. The opening portion 201 has an opening shape extending in the Xa direction. Six opening portions 201 are aligned in the Y direction.

In this case, the COF substrate 98 according to this embodiment includes a lower end portion 98*c* and an upper end portion 98*d*, as illustrated in FIG. 16. The lower end portion 98*c* is one end portion of the COF substrate 98, which is close, in the Z direction, to the head main body 110. The upper end portion 98*d* is the other end portion of the COF substrate 98, which is far away, in the Z direction, from the head main body 110. The width of the upper end portion 98*d* in the Xa direction is smaller than the width of the lower end portion 98*c* in the Xa direction.

In this embodiment, a part of the COF substrate 98, which is inserted through the first opening portion 215, and a part of the COF substrate 98, which is inserted through the third opening portion 235, have a rectangular shape of which the Xa-direction width is constant. A part of the COF substrate 98, which is inserted through the second opening portion 225, has a trapezoidal shape of which the Xa-direction width is reduced as the part of the COF substrate 98 extends from the Z1 side to the Z2 side.

Meanwhile, the opening portion 201 of the flow-path member 200 has a first opening 236 (in other words, the Z1-side opening of the third opening portion 235) and a second opening 216 (in other words, the Z2-side opening of the first opening portion 215). In the Z direction perpendicular to the liquid ejection surface 20*a*, the first opening 236 is close to the head main body 110 and the second opening 216 is far away from the head main body 110.

The size of the second opening 216 in the Xa direction is smaller than the size of the first opening 236 in the Xa direction. In other words, the width of the opening portion 201 in the Xa direction is reduced as the opening portion 201 extends from the Z1 side to the Z2 side in the Z direction. Specifically, the opening portion 201 has a shape allowing the COF substrate 98 to be accommodated therein. The width of the opening portion 201 in the Xa direction is slightly greater than the width of the COF substrate 98 in the Xa direction.

Other Embodiments

Hereinbefore, the embodiments of the invention are described. However, the basic configuration of the invention is not limited thereto.

In the recording head 100 according to Embodiment 1, the first flow path 241 and the second flow path 242 are provided and the first distribution flow path 251 and the second distribution flow path 252 are located at different positions in the Z direction. However, the configuration is not limited thereto. A recording head may include a flow-path member in which flow paths parallel to the liquid ejection surface 20*a* are provided in, for example, only the same plane. According to the embodiment described above, a recording head may have a configuration in which only second flow path is provided in a flow-path member including the first flow-path member 210 and the second flow-path member 220. In the case of the recording head in which either the first flow path 241 or the second flow path 242 is not provided, as described above, the Z-direction size of the recording head 100 can be reduced.

In the recording head 100 according to Embodiment 1, the introduction paths 44*c*, 44*d*, 44*a*, and 44*b* are connected to the first flow path 241*a*, the first flow path 241*b*, the second flow path 242*a*, and the second flow path 242*b*. However, the configuration is not limited thereto. The introduction paths 44*c* and 44*b*, for example, may be connected to the first flow path 241*a* and the first flow path 241*b* and the introduction paths 44*a* and 44*d* may be connected to the second flow paths 242*a* and 242*b*. In this case, a recording head may have only the second flow path without the first flow path. It is possible to provide an optimal flow path having the optimal configuration in relation to, for example, the arrangement of the head main bodies 110.

The second flow path 242 is formed by causing the first flow-path member 210 and the second flow-path member 220 to adhere to each other and the first flow path 241 is formed by causing the second flow-path member 220 and the third flow-path member 230 to adhere to each other. However, the method of forming the first flow path 241 and the second flow path 242 is not limited thereto. The first flow path 241 and the second flow path 242 may be integrally formed, without causing two or more flow-path member to adhere to each other, by a lamination forming method allowing three-dimensional forming. Alternatively, each flow-path member may be formed by three-dimensional forming, molding (for example, injection molding), cutting, pressing.

The flow-path member 200 has, as the first flow path 241, two flow paths which are the first flow path 241*a* and the first flow path 241*b*. However, the number of first flow paths is not limited thereto. One first flow path may be provided or three or more first flow paths may be provided. The second flow path 242 has a similar configuration to that described above.

The first distribution flow path 251*a* branches into the six first bifurcation flow paths 261*a*. However, the configuration is not limited thereto. The first distribution flow path 251*a* may be connected to one head main body 110, without being branched. The number of branched-off flow paths is not limited to six and may be two or more. The first distribution flow path 251*b*, the second distribution flow path 252*a*, and the second distribution flow path 252*b* have a similar configuration to that described above.

The cross-sectional area of the distribution flow path 250 is reduced in accordance with the number of distribution points. However, the cross-sectional area of the distribution flow path 250 may not be reduced and be constant. Furthermore, in the flow path A1 of the first stage and the flow path A2 of the second stage, the diameters of the introduction flow paths 280 are set to be different from each other and, further, the cross-sectional areas of parts of the distribution flow paths 250, which are the portions extending to the intersection portions 410, are set to be different from each other. However, in the flow path A1 of the first stage and the flow path A2 of the second stage, the cross-sectional areas may not be different from each other and may be the same.

In either configuration, it is possible to more effectively flow the air bubbles 403 to the lower side in the vertical direction, as long as the cross-sectional area of the vertical flow path 270 is smaller than that of the bifurcation flow path 260.

The first distribution flow path 251*a* is a flow path through which ink horizontally flows in a portion between the second flow-path member 220 and the third flow-path member 230. However, the configuration is not limited thereto. In other words, the first distribution flow path 251*a* may be a flow path inclined with respect to a Z plane. The first distribution flow path 251*b*, the second distribution flow path 252*a*, and the second distribution flow path 252*b* have a similar configuration.

Furthermore, the first vertical flow path 271*a* is perpendicular to the liquid ejection surface 20*a*. However, the configuration is not limited thereto. In other words, the first vertical flow path 271*a* may be inclined with respect to the liquid ejection surface 20*a*. The first vertical flow path 271*b*, the second vertical flow path 272*a*, and the second vertical flow path 272*b* have a similar configuration.

It is not necessary to set the Xa-direction width of the second opening 216 of the opening portion 201 in the flow-path member 200 to be smaller than that of the first opening 236. The second opening 216 and the first opening 236 may be openings of which the Xa-direction widths are substantially the same and which allow the rectangular-shaped COF substrate 98 to be accommodated therein. On the contrary, the Xa-direction width of the second opening 216 may be greater than that of the first opening 236.

The COF substrate 98 is provided as a flexible wiring substrate. However, a flexible print substrate (FPC) may be used as the COF substrate 98.

In Embodiment 1, the head main bodies 110 are aligned in the Y direction and the recording head 100 is constituted of the plurality of head main bodies 110. However, the recording head 100 may be constituted of one head main body 110. Furthermore, the number of recording heads 100 in the head unit 101 is not particularly limited. The number of recording heads 100 may be two or more. Alternatively, one single recording head 100 may be mounted in the ink jet type recording apparatus 1.

In Embodiment 1, the holding member 120 and the flow-path member 200 are fixed using, for example, an adhesive. However, the holding member 120 and the flow-path member 200 may be integrally formed. In other words, both the hold portion 121 and the leg portion 122 may be provided on the Z1 side of the flow-path member 200. Accordingly, the holding member 120 is not stacked in the Z direction, the Z-direction size of the flow-path member 200 can be reduced. Furthermore, since the hold portion 121 is provided in the flow-path member 200, the size of the flow-path member 200 in both the X direction and in the Y direction can be reduced because it is necessary for the flow-path member 200 to accommodate only a plurality of head main bodies 110 and it is not necessary for the flow-path member 200 to accommodate the relay substrate 140. Furthermore, a plurality of members are integrally formed, and thus the number of parts can be reduced. When the flow-path member 200 is constituted of the first flow-path member 210, the second flow-path member 220, and the third flow-path member 230, both the hold portion 121 and the leg portion 122 may be provided on the Z1 side of the third flow-path member 230.

The ink jet type recording apparatus 1 described above is a so-called line type recording apparatus in which the head unit 101 is fixed and only the recording sheet S is transported, in such a manner that printing is performed. However, the configuration is not limited thereto. The invention can be applied to a so-called serial type recording apparatus in which the head unit 101 and one or a plurality of recording heads 100 are mounted on a carriage, the head unit 101 or the recording head 100 move in a main scanning direction intersecting the transporting direction of the recording sheet S, and the recording sheet S is transported, in such a manner that printing is performed.

The invention is intended to be applied to a general liquid ejecting head unit. The invention can be applied to a liquid ejecting head unit which includes a recording head of, for example, an ink jet type recording head of various types used for an image recording apparatus, such as a printer, a coloring material ejecting head used to manufacture a color filter for a liquid crystal display or the like, an electrode material ejecting head used to form an electrode for an organic EL display, a field emission display (FED) or the like, or a bio-organic material ejecting head used to manufacture a biochip.

A wiring substrate of the invention is not intended to be applied to only a liquid ejecting head and can be applied to, for example, a certain electronic circuit.

What is claimed is:

1. A flow-path forming member comprising:

a first flow path through which liquid flows in an intersection direction intersecting a vertical direction;

a second flow path which is connected to the first flow path and through which the liquid flows downward in the vertical direction; and a first member and a second member, wherein the first flow path includes an intersection portion which has a surface intersecting the intersection direction, and a cross-sectional area of the first flow path in a plane perpendicular to the intersection direction gradually decreases as the first flow path extends to the second flow path, wherein the first flow path is formed by the first member and the second member, and wherein the intersection portion is not formed in the first member but is formed in the second member.

2. The flow-path forming member according to claim 1, wherein the intersection portion of the first flow path has the intersection surface on a lower side in the vertical direction.

3. A liquid ejecting head comprising:

the flow-path forming member according to claim 2, and a head main body which receives the liquid from the flow-path forming member and ejects the liquid.

4. The flow-path forming member according to claim 1, wherein a plurality of groups of the first flow paths and the second flow paths are provided, wherein the respective first flow paths of the plurality of groups communicate with a distribution flow path, wherein the distribution flow path communicates with an inlet port to which the liquid from a liquid supply source is supplied from the vertical direction, and wherein the respective intersection portions of the first flow paths of the groups have different shapes in accordance with distances from the inlet port to the respective second flow paths.

5. The flow-path forming member according to claim 4, wherein the groups of the first flow paths and the second flow paths include a first group and a second group in which the distance from the inlet port to the second flow path is longer than that of the first group, and wherein the distance from a start position of the intersection portion of the first group to the second flow path is longer than that of the second group.

6. A liquid ejecting head comprising:

the flow-path forming member according to claim 5, and a head main body which receives the liquid from the flow-path forming member and ejects the liquid.

7. The flow-path forming member according to claim 4, wherein the groups of the first flow paths and the second flow paths include a first group and a second group in which the distance from the inlet port to the second flow path is longer than that of the first group, and wherein the distance from an end position of the intersection portion of the first group to the second flow path thereof is longer than that of the second group.

8. A liquid ejecting head comprising:

the flow-path forming member according to claim 7, and a head main body which receives the liquid from the flow-path forming member and ejects the liquid.

9. The flow-path forming member according to claim 4, wherein the cross-sectional area of a part of the distribution flow path, which is the portion from the inlet port to a first bifurcation flow path which branches off first is greater than the cross-sectional area of a part of the distribution flow path, which is the portion downstream from the first bifurcation flow path which branches off first.

10. A liquid ejecting head comprising:

the flow-path forming member according to claim 4, and a head main body which receives the liquid from the flow-path forming member and ejects the liquid.

11. The flow-path forming member according to claim 1, wherein a part of the intersection portion, which decides the cross-sectional area, is located further on the second member side than an overlapping surface between the first member and the second member.

12. The flow-path forming member according to claim 1, further comprising:

a third member, wherein, when a plurality of groups of the first flow paths and the second flow paths are provided, there is a first flow path formed by the second member and the third member, in addition to a first flow path formed by the first member and the second member.

13. The flow-path forming member according to claim 12, wherein the intersection portion of the first flow path formed by the second member and the third member is formed not in the second member but in the third member.

14. The flow-path forming member according to claim 12, wherein, when a first flow path of a first stage, which is formed by the first member and the second member, and a first flow path of a second stage, which is formed by the second member and the third member, are projected onto a plane including the intersection direction and the vertical direction, the projection images thereof do not overlap each other.

15. The flow-path forming member according to claim 12, wherein, when a first flow path of a first stage, which is formed by the first member and the second member, and a first flow path of a second stage, which is formed by the second member and the third member, are projected onto a plane including the intersection direction and the vertical direction, the projection images thereof overlap each other.

16. The flow-path forming member according to claim 12, wherein a plurality of groups of the first flow paths and the second flow paths of the first stage and a plurality of groups of the first flow paths and the second flow paths of the second stage are provided, wherein the respective first flow paths of the first stage communicate with a first distribution flow path and the respective first flow paths of the second stage communicate with a second distribution flow path, wherein the respective first distribution flow paths and the respective second distribution flow paths communicate with inlet ports to which the liquid from a liquid supply source is supplied from the vertical direction, and wherein the cross-sectional area of the first distribution flow path is smaller than that of the second distribution flow path.

17. The flow-path forming member according to claim 1, wherein the cross-sectional area of the second flow path is smaller than that of the first flow path communicating with the second flow path.

18. A liquid ejecting head comprising:

the flow-path forming member according to claim 1, and a head main body which receives the liquid from the flow-path forming member and ejects the liquid.

19. A liquid ejecting apparatus comprising:

the liquid ejecting head according to claim 18; and a plurality of nozzle openings which receive the liquid from the head main body and which eject the liquid.

* * * * *